US009757963B2

(12) United States Patent
Shapira et al.

(10) Patent No.: US 9,757,963 B2
(45) Date of Patent: Sep. 12, 2017

(54) SYSTEM AND METHOD FOR TRANSPORTING SUBSTRATES

(71) Applicant: SCODIX LTD., Rosh HaAin (IL)

(72) Inventors: Gur Shapira, Zoran (IL); Amit Apelbaum, Modiin (IL); Eli Grinberg, Pardesia (IL); Kobi Bar, Kefar Sava (IL)

(73) Assignee: SCODIX LTD., Rosh HaAin (IL)

( * ) Notice: Subject to any disclaimer, the term of this patent is extended or adjusted under 35 U.S.C. 154(b) by 120 days.

(21) Appl. No.: 14/887,409

(22) Filed: Oct. 20, 2015

(65) Prior Publication Data

US 2016/0039223 A1 Feb. 11, 2016

Related U.S. Application Data

(63) Continuation-in-part of application No. 13/878,243, filed as application No. PCT/IL2011/000843 on Oct. 30, 2011, now abandoned.

(60) Provisional application No. 61/408,819, filed on Nov. 1, 2010.

(51) Int. Cl.

| | |
|---|---|
| ***B41J 11/00*** | (2006.01) |
| ***B41J 11/20*** | (2006.01) |
| ***B65H 5/10*** | (2006.01) |
| ***B41J 11/06*** | (2006.01) |
| ***B65H 29/04*** | (2006.01) |
| ***B65H 3/08*** | (2006.01) |
| ***B65H 5/04*** | (2006.01) |
| *B65H 29/00* | (2006.01) |

(52) U.S. Cl.

CPC ..... *B41J 11/0085* (2013.01); *B41J 11/06* (2013.01); *B41J 11/20* (2013.01); *B65H 3/0816* (2013.01); *B65H 5/04* (2013.01); *B65H 5/10* (2013.01); *B65H 29/041* (2013.01); *B65H 29/003* (2013.01); *B65H 2301/4473* (2013.01); *B65H 2301/44718* (2013.01); *B65H 2406/342* (2013.01); *B65H 2406/351* (2013.01)

(58) Field of Classification Search

CPC ..... B41J 11/0085; B41J 11/06; B41J 11/20; B65H 3/0816; B65H 5/04; B65H 5/10; B65H 29/041; B65H 2301/44718; B65H 2301/4473; B65H 2406/342; B65H 2406/351

See application file for complete search history.

(56) References Cited

U.S. PATENT DOCUMENTS

| | | | |
|---|---|---|---|
| 3,211,073 | A | 10/1965 | Fosse et al. |
| 4,305,331 | A | 12/1981 | Colapinto |
| 4,380,331 | A | 4/1983 | Fischer |
| 4,681,502 | A | 7/1987 | Staufner |

(Continued)

OTHER PUBLICATIONS

International Search Report in PCT/IL2011/000843 dated May 2, 2012.

*Primary Examiner* — Thinh H Nguyen
(74) *Attorney, Agent, or Firm* — Manelli Selter PLLC; Edward J. Stemberger

(57) ABSTRACT

A substrate unloading system comprising a gripper mounted on a slanted plane and movable along the slanted plane, and a platen onto which the substrate is attached, the platen configured to be moved down in a vertical direction and away from the gripper in a horizontal direction, the gripper and the platen configured to move simultaneously so that the substrate remains substantially horizontal.

20 Claims, 23 Drawing Sheets

(56) References Cited

U.S. PATENT DOCUMENTS

| | | | | |
|---|---|---|---|---|
| 5,967,508 | A * | 10/1999 | Olexy | B65H 5/10 271/106 |
| 7,280,183 | B2 | 10/2007 | Fukui | |
| 2007/0068403 | A1 | 3/2007 | Fresener et al. | |
| 2009/0079832 | A1 | 3/2009 | Moore et al. | |
| 2010/0122634 | A1 | 5/2010 | Doyle | |

* cited by examiner

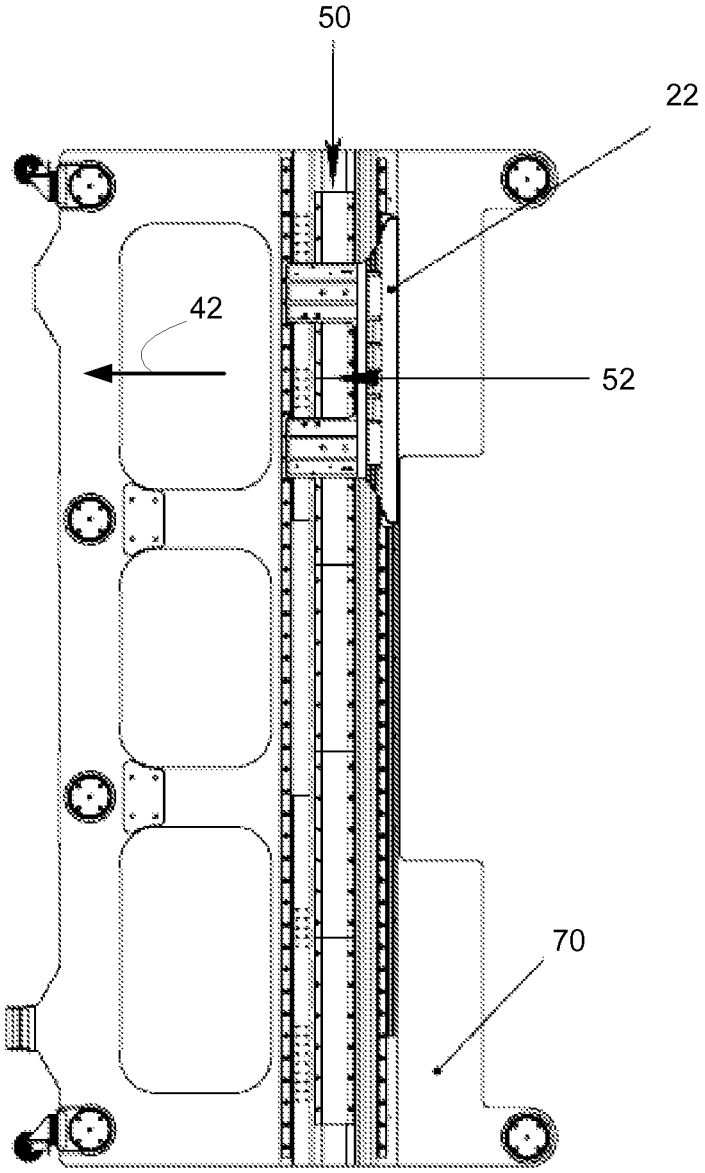
Fig 8A – Section A-A

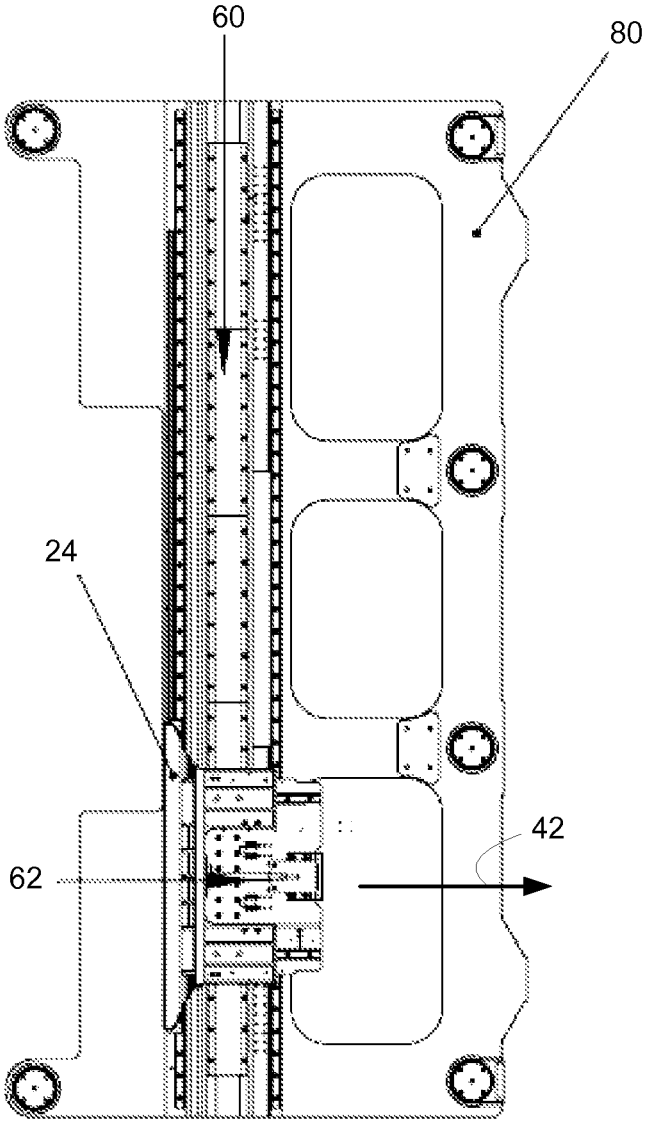
Fig. 8B – Section B-B

SYSTEM AND METHOD FOR TRANSPORTING SUBSTRATES

CROSS-REFERENCE TO RELATED PATENT APPLICATIONS

This patent application is a Continuation in Part of U.S. patent application Ser. No. 13/878,243 filed 22 Apr. 2013, which was filed as a national phase application of International Patent Application No. PCT/IL2011/000843 filed 30 Oct. 2011, which in turn claimed priority from U.S. Provisional Patent Application Ser. No. 61/408,819, filed 1 Nov. 2010.

FIELD OF THE INVENTION

The present invention is directed to inkjet printing systems and more particularly to transporting media between various stations of an inkjet printing system.

BACKGROUND

Flatbed industrial digital inkjet printers are equipped with a fully automatic printing process, from loading a substrate, through printing and drying to unloading.

There is need for enhancing the productivity of existing inkjet printers by treating more than one substrate at each given time, so that each of the substrates gets treated in a different station of the printing system.

SUMMARY

According to an aspect of the present invention there is provided a printing system comprising a load station to load one or more substrates; the load station comprises: a platform configured to be moved in the horizontal direction; a row of vacuum grippers configured to grip the substrate at one end thereof; at least one row of Bernoulli grippers; the platform comprising a fixed part and a movable part, the movable part configured to rotate around a motor-activated axis, the row of vacuum grippers attached to the movable part and the at least one row of Bernoulli grippers attached to the fixed part; and a ramp configured to press the substrate being loaded to the at least one row of Bernoulli grippers; a first platen to receive the one or more substrates, the first platen movably connected to a first side of the system; a second platen to receive the one or more substrates, the second platen movably connected to a second side of the system, the second side opposite the first side; a platen transport system operatively connected to the load station, the platen transport system moving the first and second platens in the system independently; an alignment station which aligns the one or more substrates on the first and second platens; a print station which prints the one or more substrate on the first and second platens; and an unload station which unloads the one or more substrates from the first and second platens, wherein the transport system comprises means to move the first and second platens in a horizontal direction and means to move the first and second platens in a vertical direction.

The system may further comprise a curing/drying station which cures/dries the printed one or more substrates.

The alignment station may be configured to determine the degree of misalignment of the one or more substrates on the first and second platens according to predetermined alignment positions.

The alignment station may include a plurality of cameras which view the location of two or more edges of the substrate to compare such locations with the predetermined alignment positions.

The plurality of cameras may be CCD cameras.

The print station may include one or more ink jet print heads to print material onto the one or more substrates.

The inkjet print heads may be fixed.

The inkjet print heads may be movable.

The material to be printed may include one of: ink, varnish, color ink and clear ink.

The alignment station may be configured to provide signals to the print station to cause the one or more ink jet heads to correct for any misalignment detected by the alignment station.

The first and second platens may be supported and carried by rails within the system, the rails transporting each of the first and second platens through the system in the horizontal direction.

The first and second platens may move in opposite horizontal directions within the system.

The system may further include mechanisms configured to raise and lower the first and second platens to avoid the first and second platens contacting each other.

The system may further comprise a mechanism on each of the first and second platens to secure the one or more substrates from movement on the platens.

The mechanism may include one or more of: a vacuum hold-down, grippers and suction cups.

According to another aspect of the present invention there is provided a printing method comprising: providing a load station to load one or more substrates; the load station comprises: a platform configured to be moved in the horizontal direction; a row of vacuum grippers configured to grip the substrate at one end thereof; at least one row of Bernoulli grippers; the platform comprising a fixed part and a movable part, the movable part configured to rotate around a motor-activated axis, the row of vacuum grippers attached to the movable part and the at least one row of Bernoulli grippers attached to the fixed part; and a ramp configured to press the substrate being loaded to the at least one row of Bernoulli grippers; providing a first platen to received one or more substrates from the load station; providing a second platen to received one or more substrates from the load station; providing a platen transport system operatively connected to the load station, the platen transport system adapted to move the first and second platens in the system independently in a horizontal direction and in a vertical direction; loading one or more substrates to the first platen; moving the first platen horizontally to an alignment station which aligns the one or more substrates on the first platen; moving the first platen horizontally to a print station, the print station printing onto the one or more substrates on the first platen; moving the first platen horizontally to an unload station which unloads the one or more substrates from the first platen; loading one or more substrates to the second platen; moving the second platen horizontally to an alignment station which aligns the one or more substrates on the second platen; moving the second platen horizontally to a print station, the print station printing onto the one or more substrates on the second platen; and moving the second platen horizontally to an unload station which unloads the one or more substrates from the second platen, wherein the moving the first platen to the alignment station and the moving the second platen to the alignment station occur at different times, wherein the moving the first platen to the print station and the moving the second platen to the print station occur at different times, wherein the moving the first platen to the unload station and the moving the second platen to the unload station occur at different times, and wherein the first and second platens are moved vertically between the horizontal movements to avoid interference.

The method may further comprise moving the first platen to a curing/drying station which cures/dries the one or more substrates which have been printed and moving the second platen to a curing station which cures the one or more substrates which have been printed, wherein the moving the first platen to the curing station and the moving the second platen to the curing station occur at different times.

The print station may include one or more print heads selected from: ink jet print heads, a toner-based print head, a silk screen print head, a lithography-based print head and a laser print head. The loading may comprise:

a. gripping a first end of each the one or more substrates with a first row of vacuum grippers;
b. elevating the one or more gripped ends;
c. moving the one or more substrates in the horizontal direction of the first row of grippers;
d. pressing the one or more substrate against a ramp and gripping it with a second row of Bernoulli grippers;
e. repeating steps (c) and (d) if additional rows of grippers exist; and
f. releasing the one or more substrates from the grippers onto a platen.

The unload station may comprise a gripper mounted on a slanted plane and movable along the slanted plane.

The unloading may comprise:

a. gripping a first end of the one or more substrates on the first platen with a row of grippers mounted on a slanted plane and movable along the slanted plane;
b. simultaneously moving the first platen in a horizontal direction away from the grippers and moving the grippers down on the slanted plane, whereby the one or more substrates remains horizontal;
c. repeating step (b) until the one or more substrates are removed from the first platen; and
d. releasing the one or more substrates from the grippers.

According to another aspect of the present invention there is provided a substrate loading system comprising: a platform configured to be moved in the horizontal direction; a row of vacuum grippers configured to grip the substrate at one end thereof; at least one row of Bernoulli grippers; the platform comprising a fixed part and a movable part, the movable part configured to rotate around a motor-activated axis, the row of vacuum grippers attached to the movable part and the at least one row of Bernoulli grippers attached to the fixed part; and a ramp configured to press the substrate being loaded to the at least one row of Bernoulli grippers.

According to another aspect of the present invention there is provided a method of loading a substrate onto a platen comprising:

a. gripping a first end of the substrate with a first row of vacuum grippers;
b. elevating the gripped end;
c. moving the substrate in the horizontal direction of the first row of grippers;
d. pressing the substrate against a ramp and gripping it with a second row of Bernoulli grippers;
e. repeating steps (c) and (d) if additional rows of grippers exist; and
f. releasing the substrate from the grippers onto a platen.

According to another aspect of the present invention there is provided a substrate unloading system comprising: a gripper mounted on a slanted plane and movable along the slanted plane; and a platen onto which the substrate is attached, the platen configured to be moved down in a vertical direction and away from the gripper in a horizontal direction, the gripper and the platen configured to move simultaneously so that the substrate remains substantially horizontal.

According to another aspect of the present invention there is provided a method of unloading a substrate from a platen comprising:

a. gripping a first end of the substrate on the platen with a row of grippers mounted on a slanted plane and movable along the slanted plane;
b. simultaneously moving the platen in both vertical and horizontal direction away from the grippers and moving the grippers down on the slanted plane until the substrate is removed from the platen, whereby the substrate remains horizontal; and
c. releasing the substrate from the grippers.

BRIEF DESCRIPTION OF THE DRAWINGS

For a better understanding of the invention and to show how the same may be carried into effect, reference will now be made, purely by way of example, to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings:

FIGS. 8*a* and 8*b* are sections of FIG. 7;

DETAILED DESCRIPTION

Disclosed herein is a system and a process for producing printed products or substrates, including a number of modules which cooperate to load, align, transport, print, cure or dry and unload such printed substrates. Thus, there is herein described a first module to load substrates to be printed, as well as a second module to align, preferably by software contained in the module, the substrate to be printed on a carrier sheet or platen in a predetermined orientation. A third module transports the carrier sheet or platen onto which a substrate to be printed has been loaded to a print module, which constitutes the fourth module. A fifth module may be a curing or drying station which cures or dries a material that has just been printed onto the substrate at the printing station. Alternatively, the curing or drying module may be located separate from the system rather than incorporated into the system to enable uninterrupted throughput of substrates through the system. A sixth module unloads the printed-upon substrate from the system. Underlying the system is a mechanism to move the substrate from the load module to the unload module in a manner so as to increase throughput.

As used herein, 'inkjet printing" refers to an adaptation of conventional technology developed for the deposition on paper, including thermal ink jets, piezoelectric ink jets or continuous ink jets, as a mechanism for the deposition of various materials in liquid form, including ink (colored or clear), water-based and solvent-based inks, adhesives and varnish onto a substrate. Printers useful in practicing the present invention may be, for example, a conventional inkjet printer, or may be any other conventional printing system such as a toner-based printer, a silkscreen printer, a lithography-based printer or a laser printer. As used herein, the terms "curing" and "drying" refer to the hardening of a polymer material deposited on a substrate by cross-linking the polymer chains, or to drying water-based ink printed upon the substrate, accomplished about by procedures that include, for example, the use of chemical additives, radiation, evaporation or heat.

Figure 1:
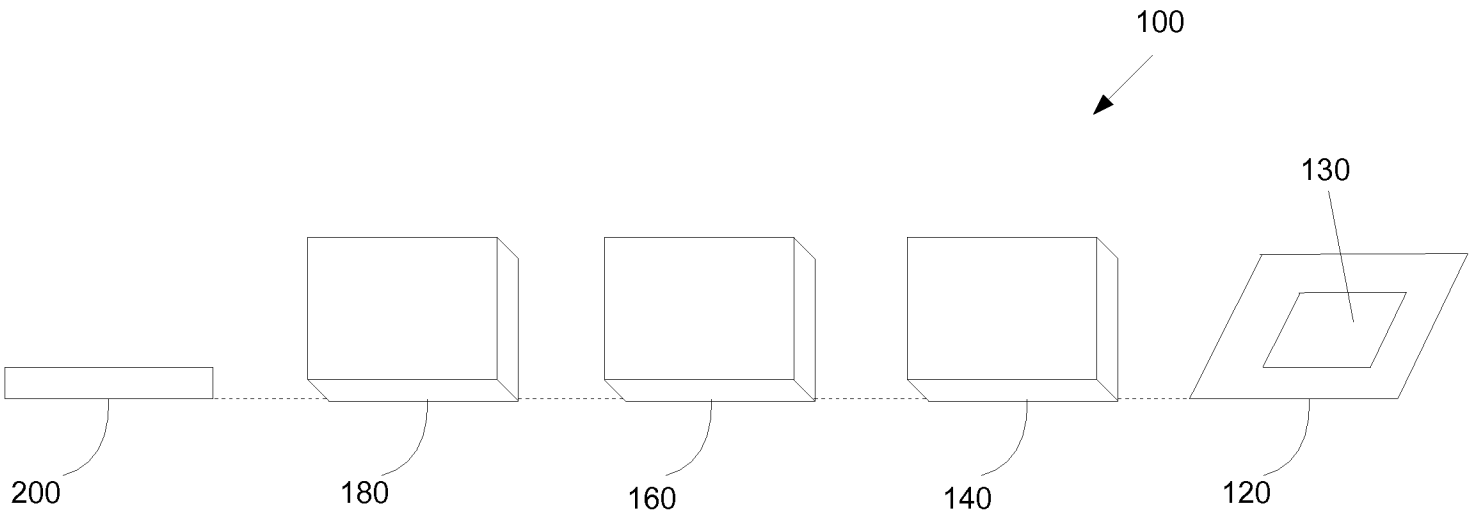
FIG. 1 is a schematic functional block diagram of an exemplary system employed to print materials.

Turning now to FIG. 1, illustrating the basic functional structure of the system 100 of the present invention, system 100 comprises a load module 120 for loading a substrate 13, an alignment module 140, a print module 160, a curing/drying module 180 and an unload module 20. The substrate transport system underlying the movement of the substrate will be detailed below but for purposes of simplification, a transport system that moves the substrate linearly from the load module 120 to the unload module 20 will be first described.

The Load Module

Figure 2:
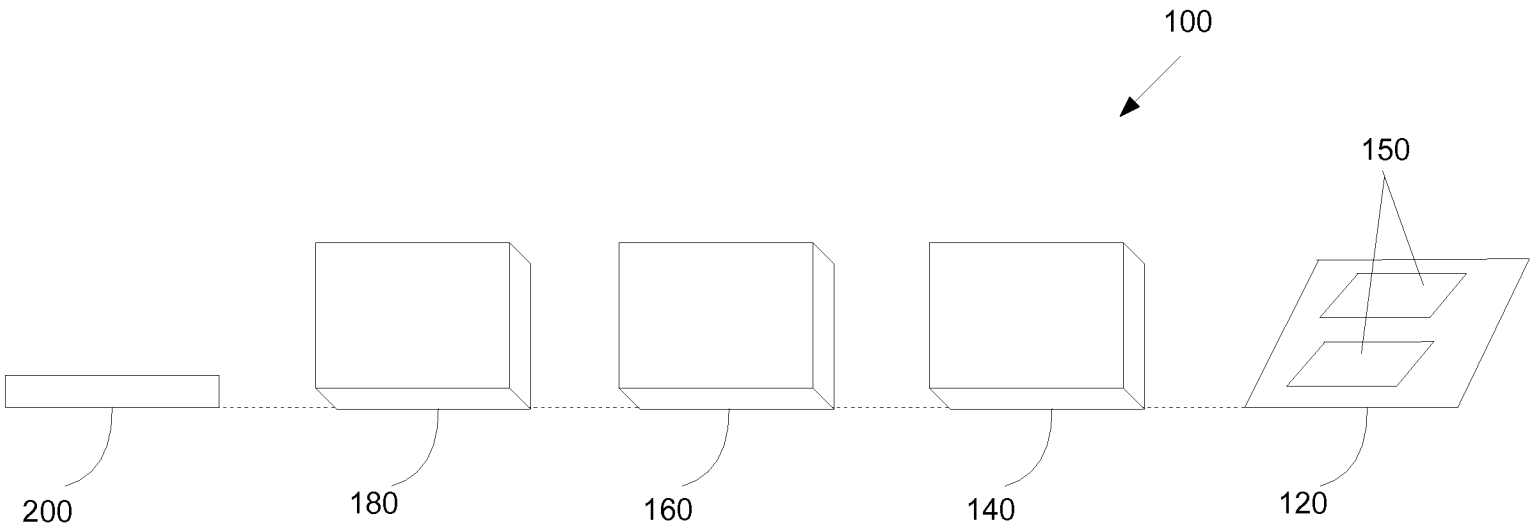
FIG. 2 is a further schematic functional block diagram of the exemplary system employed to print materials.

The load module 120 may be any type of transport mechanism to separate substrates from a stack and move the substrates onto system 100. For example, a conveyor belt may comprise the load module 120 and may move substrates one by one from a stack (not shown) into the system 100. Alternatively, vacuum suction cups or grippers which are conventionally known in the printing art may grip the edge of a substrate and transport the attached substrate first onto a platen or carrier and then into the alignment module 140, to be described below. The number of stacks which may be accommodated by load module 120 will depend upon the width of the load module and the platen or carrier and the width of the substrates, and thus more than one substrate may be moved onto the platen or carrier in parallel as can be seen in FIG. 2, wherein a pair of substrates 150 are mounted on the platen or carrier. It is intended that the load module may receive substrates which are stacked one upon each other by any number of conventional paper or substrate feeders such as are known in the printing and the photocopying art, such as a number of parallel belts or rollers.

Figure 6:
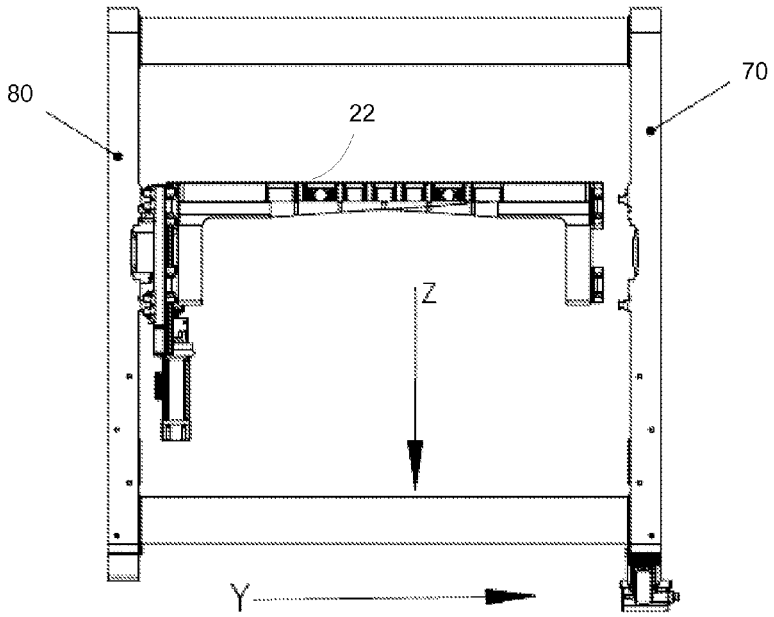
FIG. 6 is a schematic side-view of a platen mounted in the system.

Once a substrate has been removed from the stack, it is then moved onto a platen such as platen 22, as shown on FIG. 6, in which platen 22 is connected to one of system 100's walls (80). The platens which may number one or more, are moved within the system 100 in a manner to be described further below. The substrate may be moved onto the platen, again by conventional means which may include rollers or grippers which grip the edge of each substrate and pull the substrate onto the platen. Once the substrate is received on the platen, it is locked to that platen by some physical means which may include grippers, clamp hold downs or, preferably, a vacuum lock well known in the art and based upon the Venturi effect. Such a Venturi vacuum lock is available, for example, from the Piab Company (www.piab.com). The mechanisms for moving the substrate onto the platen are well known in the printing art or the photocopying art. After the substrate is affixed to the platen, the platen carrying the substrate is moved to the alignment module, to be discussed presently.

Figure 10:
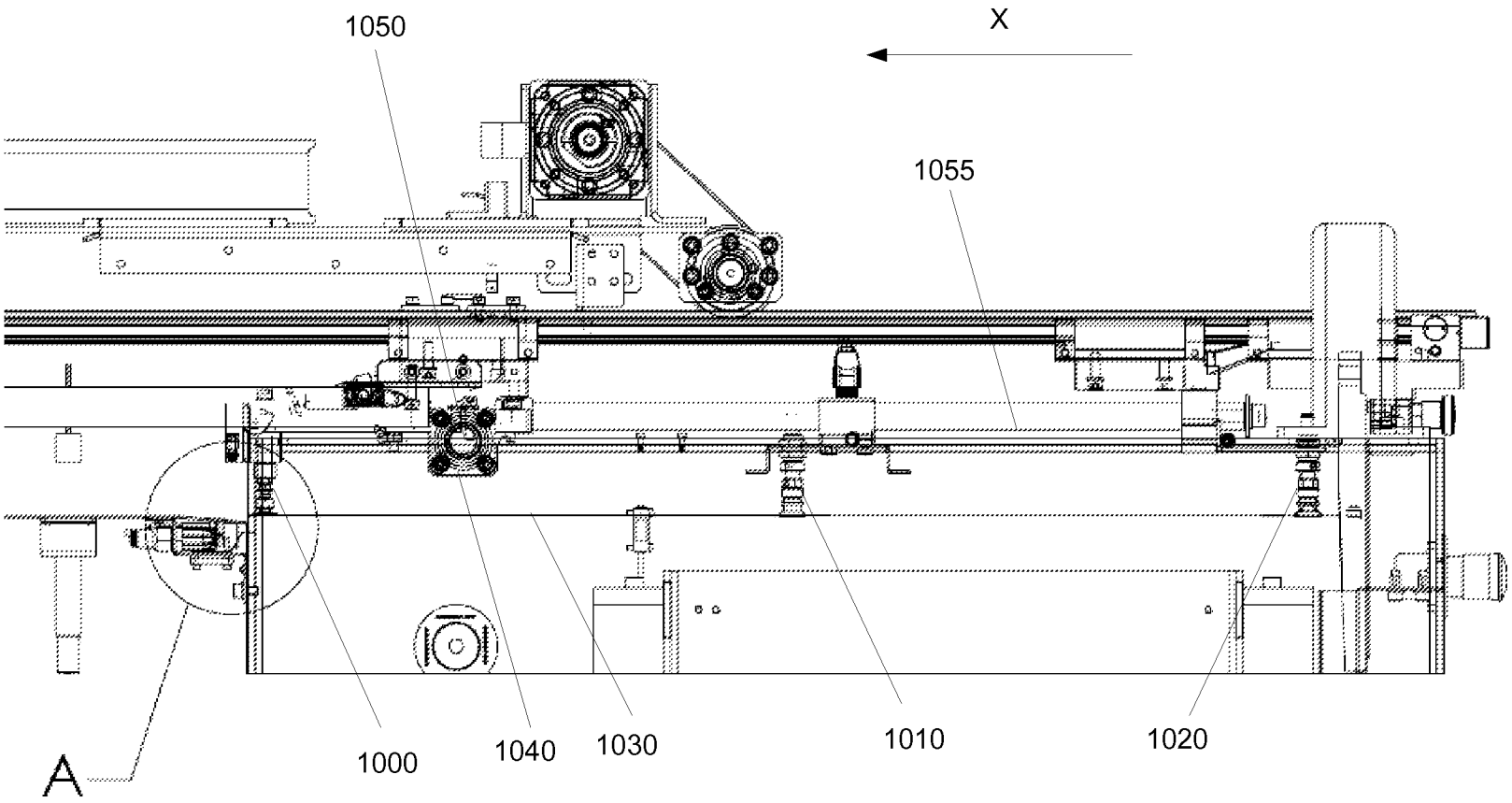
FIG. 10 is a schematic view of the loading system.

FIG. 10 is a side view of an enhanced loading mechanism for loading a substrate 1030 onto a platen 22 (not shown), comprising a first row of vacuum grippers 1000 (only one shown), a second row of Bernoulli grippers 1010 (only one shown) and a third row of Bernoulli grippers 1020 (only one shown). It is understood that more than three rows or even two rows of Bernoulli grippers are within the scope of the present invention. The Bernoulli grippers are based on the well known Bernoulli Effect. Such Bernoulli grippers are available, for example, from Festo company (www.festo-.com).

Each first gripper 1000 is preferably mounted on a piston.

The gripper assembly (1000, 1010 and 1020) is mounted on a common platform 1055, movable in the horizontal direction, along the X axis of the system. A motor 1040 driven axis 1050 enables lifting the front part of platform 1055, carrying to grippers 1000.

Figure 11:
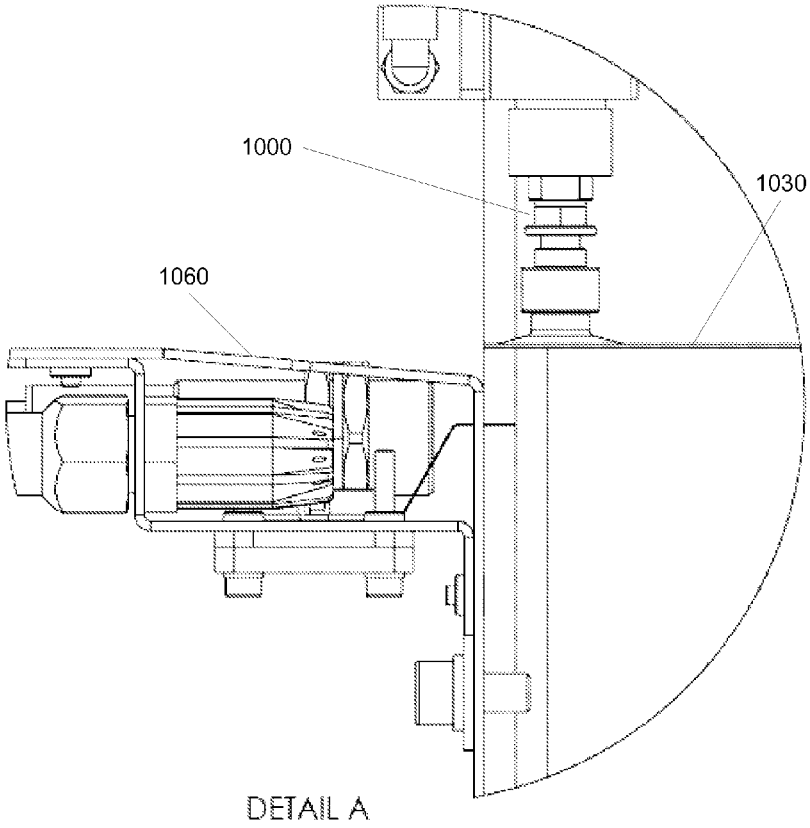
FIG. 11 is an enlarged detail of the loading system of FIG. 10.

FIG. 11 is an enlarged view of detail A of FIG. 10, showing front grippers 1000, substrate 1030 and a ramp 1060 for facilitating the substrate gripping and providing a straight, smooth substrate to the platen, as will be explained below.

FIGS. 12A through 12E show schematically the operation of the enhanced loading mechanism of FIG. 10.

Figure 12A:
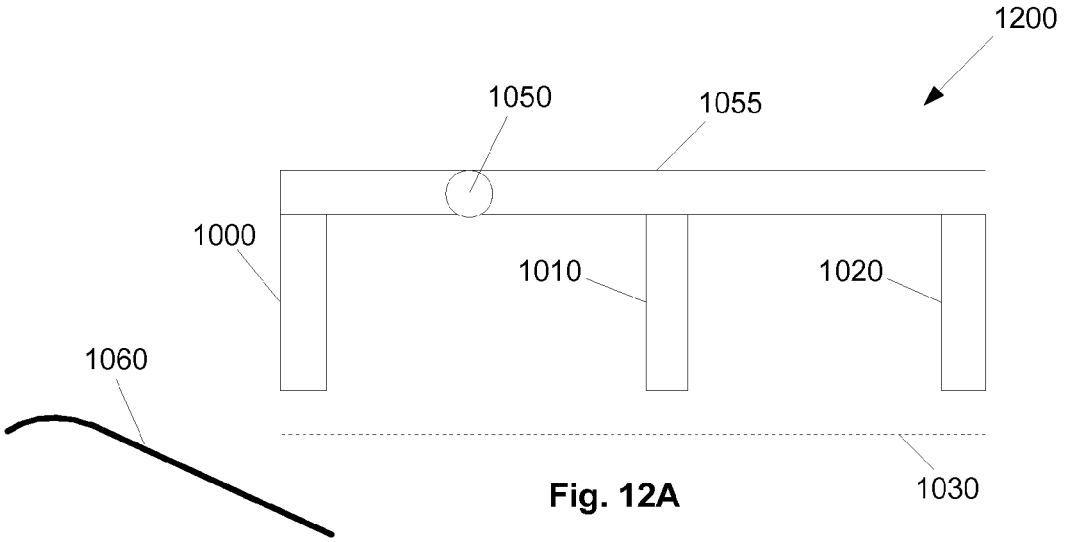
FIGS. 12*a* through 12*e* show schematically the operation of the enhanced loading mechanism of FIG. 10.

In FIG. 12A, the loading mechanism 1200 is stationed above a substrate (or stack of substrates) to be loaded (only the uppermost substrate 1030 is shown).

Figure 12B:
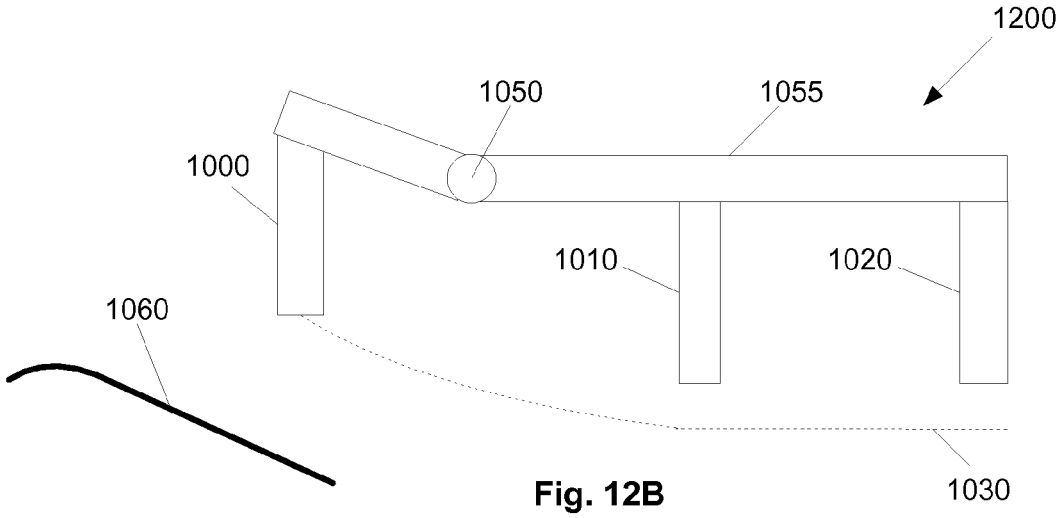

In FIG. 12B, piston-driven grippers (or motor-driven, solenoid-driven, etc.) 1000 have been moved down to grip the uppermost substrate 1030, and then moved up again holding the edge of the substrate 1030. Preferably, additional elevation of grippers 1000, along with part of platform 1055, is achieved by rotating axis 1050 as shown.

Figure 12C:
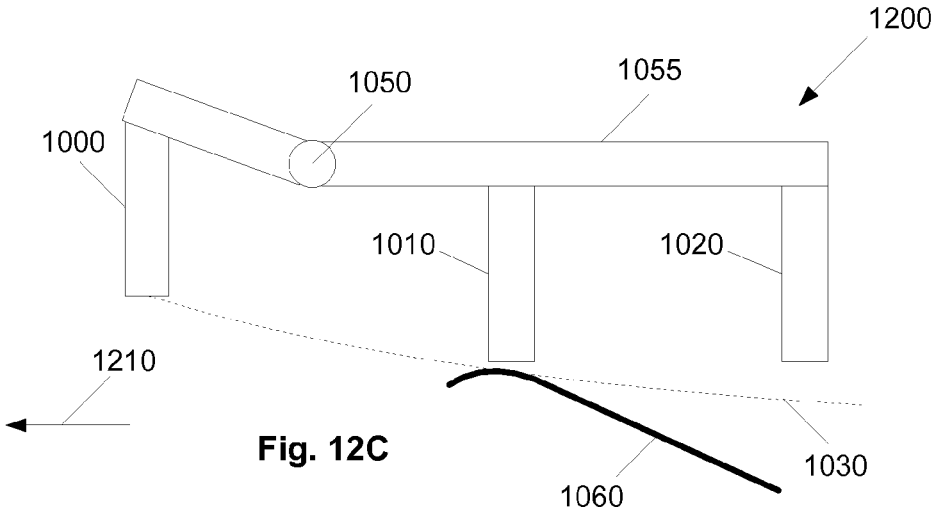

In FIG. 12C, the platform 1055 has moved forward in the direction of arrow 1210, until second grippers 1010 arrive to the ramp 1060, where the substrate 1030 is pressed against the ramp and gripped by grippers 1010. The ramp 1060 is configured to push the substrate 1030 closer to the grippers 1010 in order to assist in gripping while straitening the substrate.

Figure 12D:
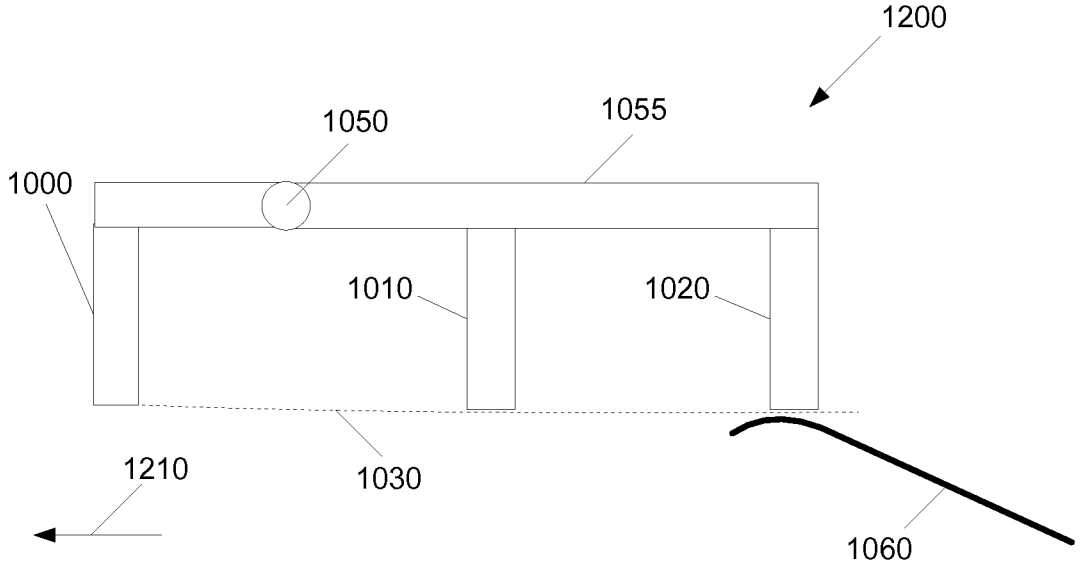

In FIG. 12D, the platform 1055 has further moved in the direction of arrow 1210, until third grippers 1020 arrive to the ramp 1060, where the substrate 1030 is pressed against the ramp and gripped by grippers 1020. At this point, axis 1050 has already been rotated back to return platform 1055 to a horizontal position.

Figure 12E:
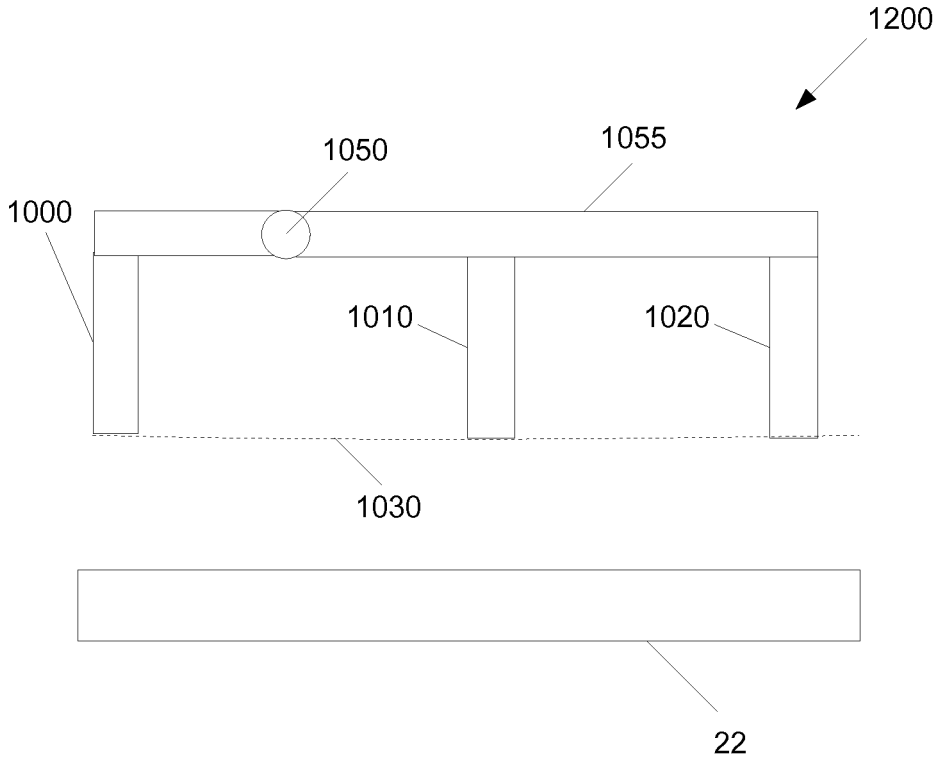

FIG. 12E shows a straight and smooth substrate 1030 gripped by all three gripper rows, from which position the substrate is dropped onto platen 22.

Using the Bernoulli grippers the system ensures that no marks will be left on the substrate. The marks that may be caused by vacuum grippers 1000 are configured to be outside the printed area.

The Alignment Module

It is desirable that the position of the substrate on the platen be registered in an accurate manner such that printing upon the substrate will be aligned, for example, with previously printed matter on the substrate. If the substrate already contains printed matter such as drawings, figures or lettering, and it may be desirable to "overprint" that image using a clear material such as a varnish, it is desirable that the areas which are printed upon be precisely aligned with the edges or outlines of the matter to be printed upon.

There are a number of methodologies by which a misaligned substrate may be aligned on the platen. Misalignment here means the lack of alignment of the substrate to some predetermined aligned position with respect to the printer module print heads. One methodology is to provide the platen the ability to move in X, Y and rotation directions so that the substrate is moved to align it with the printing station (to be described below). Another methodology is to "read" the position of the substrate on the platen and move the print head(s) to accommodate that position. Yet another methodology is to accept the position of the substrate on the platen as loaded and to correct for any misalignment using a software methodology, in which neither the substrate nor the print head moves but the print head in the printer module is adjusted to compensate for the misalignment of the substrate on the platen by "firing" certain inkjet heads.

One method of aligning the substrate on the platen is as described in International Application Number WO2009/047757 and U.S. patent application Ser. No. 12/682,163, entitled, "OVERPRINTING SYSTEM AND METHOD" which is assigned to the Assignee of the present application, the entire content of which is herein incorporated by reference. That publication describes alignment of a substrate using two reference points which are printed upon the substrate and adjusting the alignment based upon the positioning of the reference points with respect to a CCD camera which looks down on the two reference points.

In the present invention, the necessity for printing reference or alignment marks on the substrate may be eliminated. This has the advantage of the user being able to use the entire surface of the substrate to be printed upon and eliminates the requirement for cutting away to remove the reference or alignment marks after the print operation has been completed.

Figure 3A:
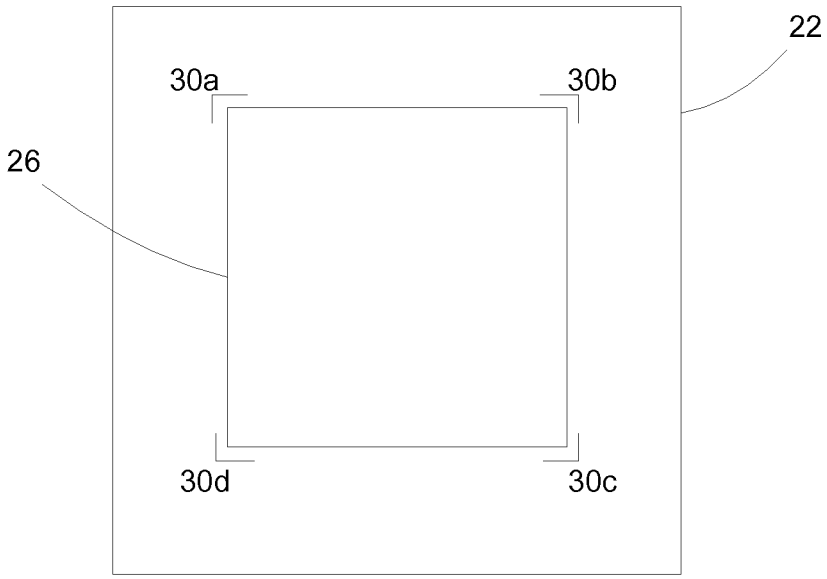
FIGS. 3*a* and 3*b* are schematic views of the alignment module according to an embodiment of the invention.
Figure 3B:
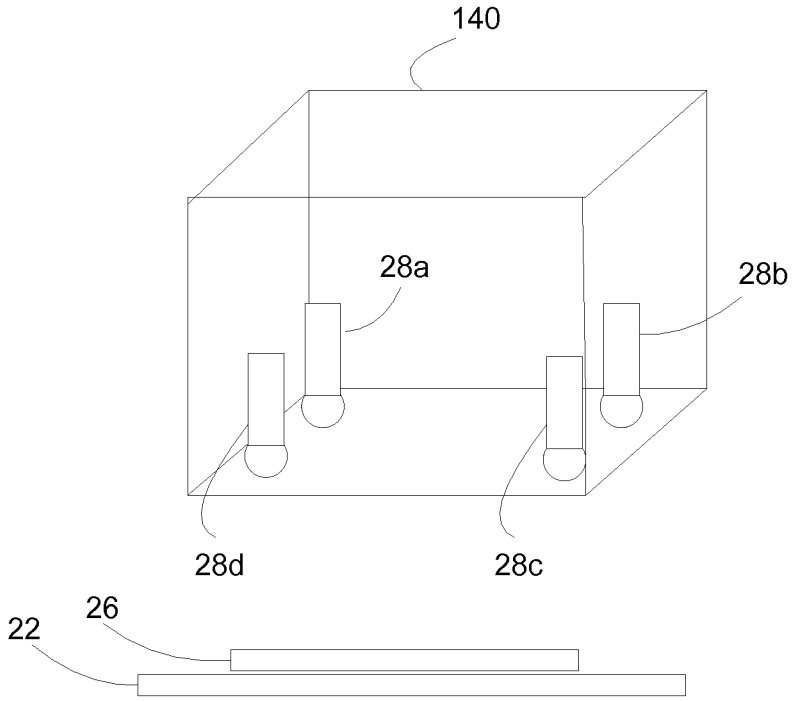
Figure 4A:
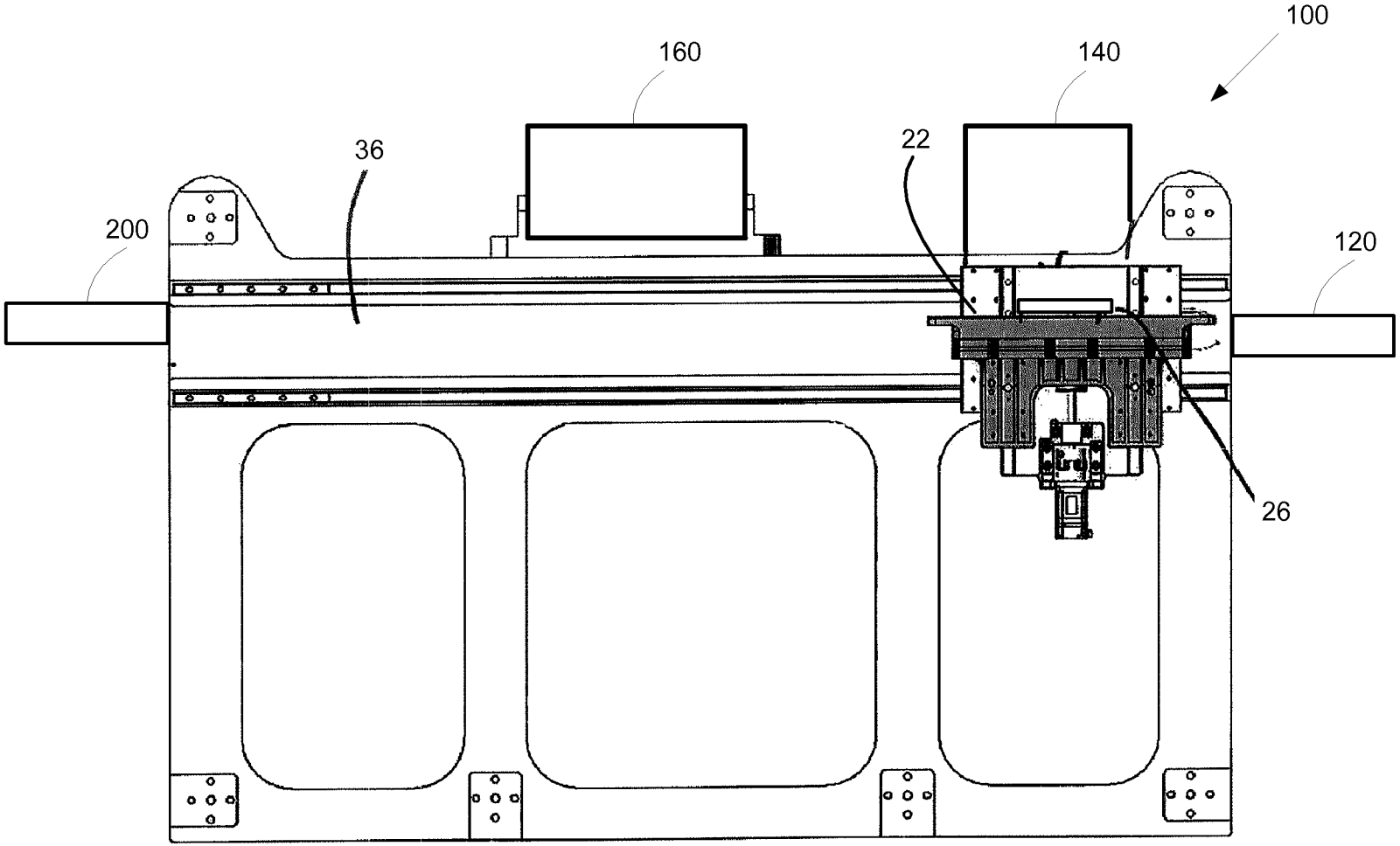
FIGS. 4*a* to 4*h* a side views which illustrate the sequence of operations in the process of printing materials upon substrates using the exemplary system of FIG. 1.
Figure 4B:
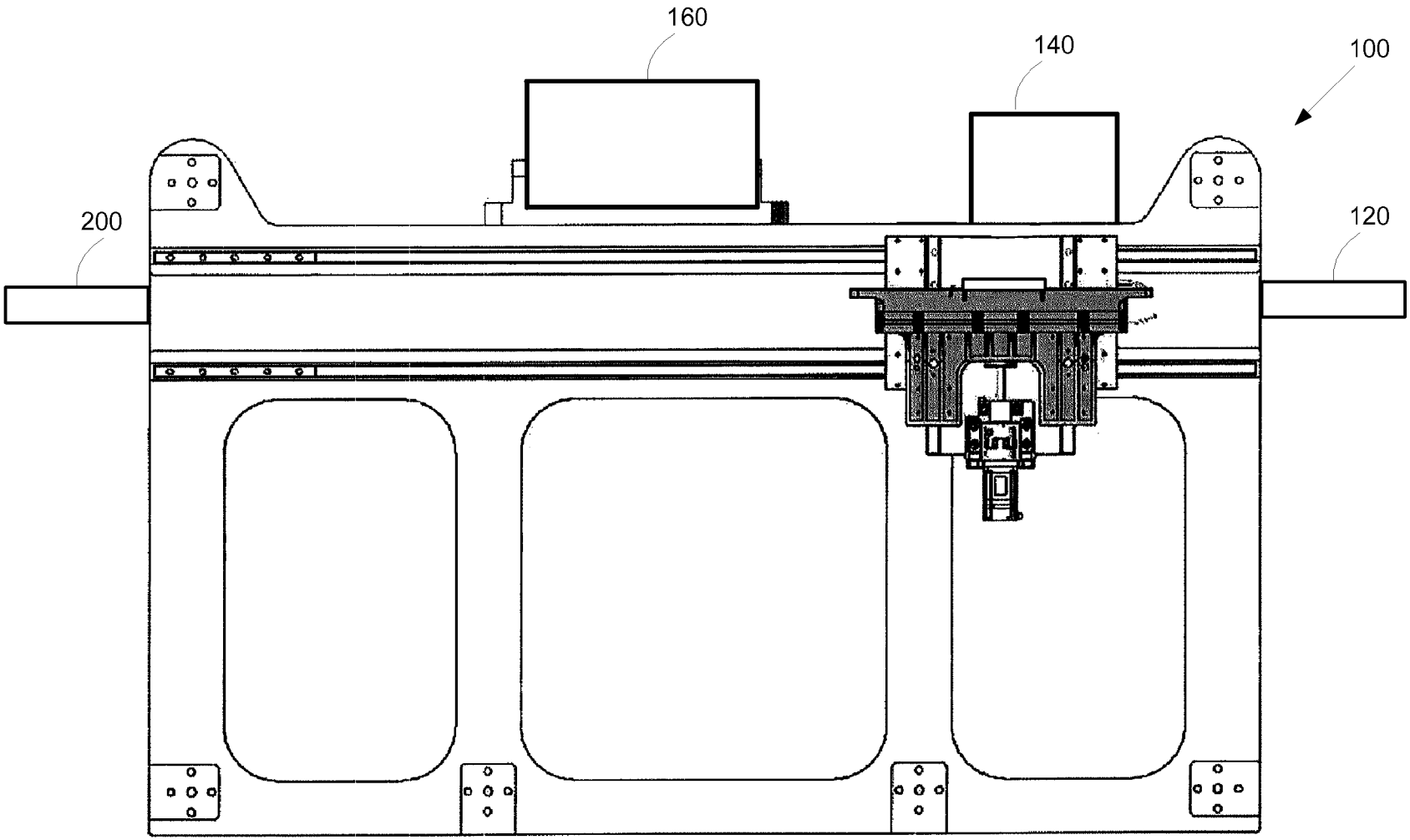
Figure 4C:
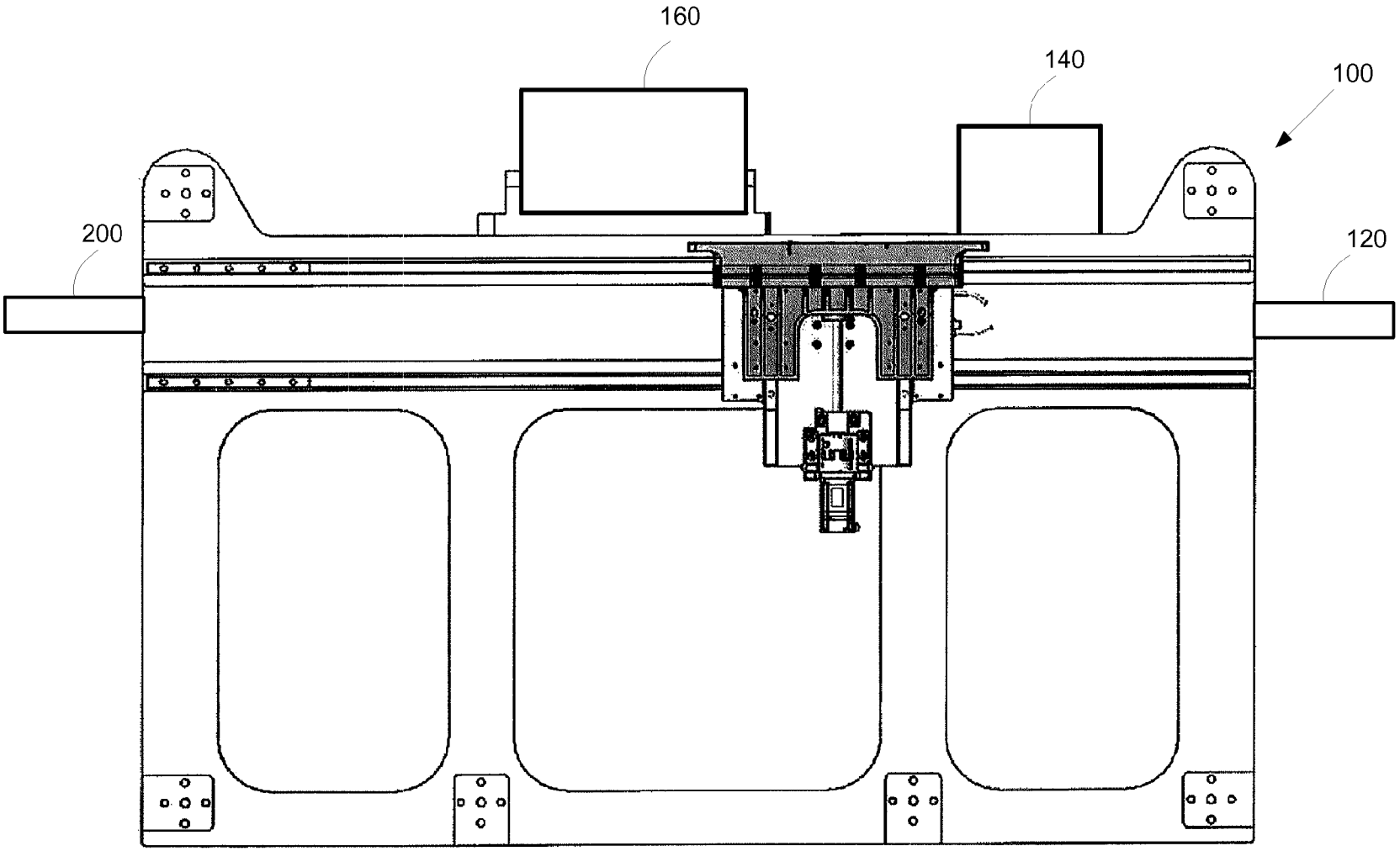
Figure 4D:
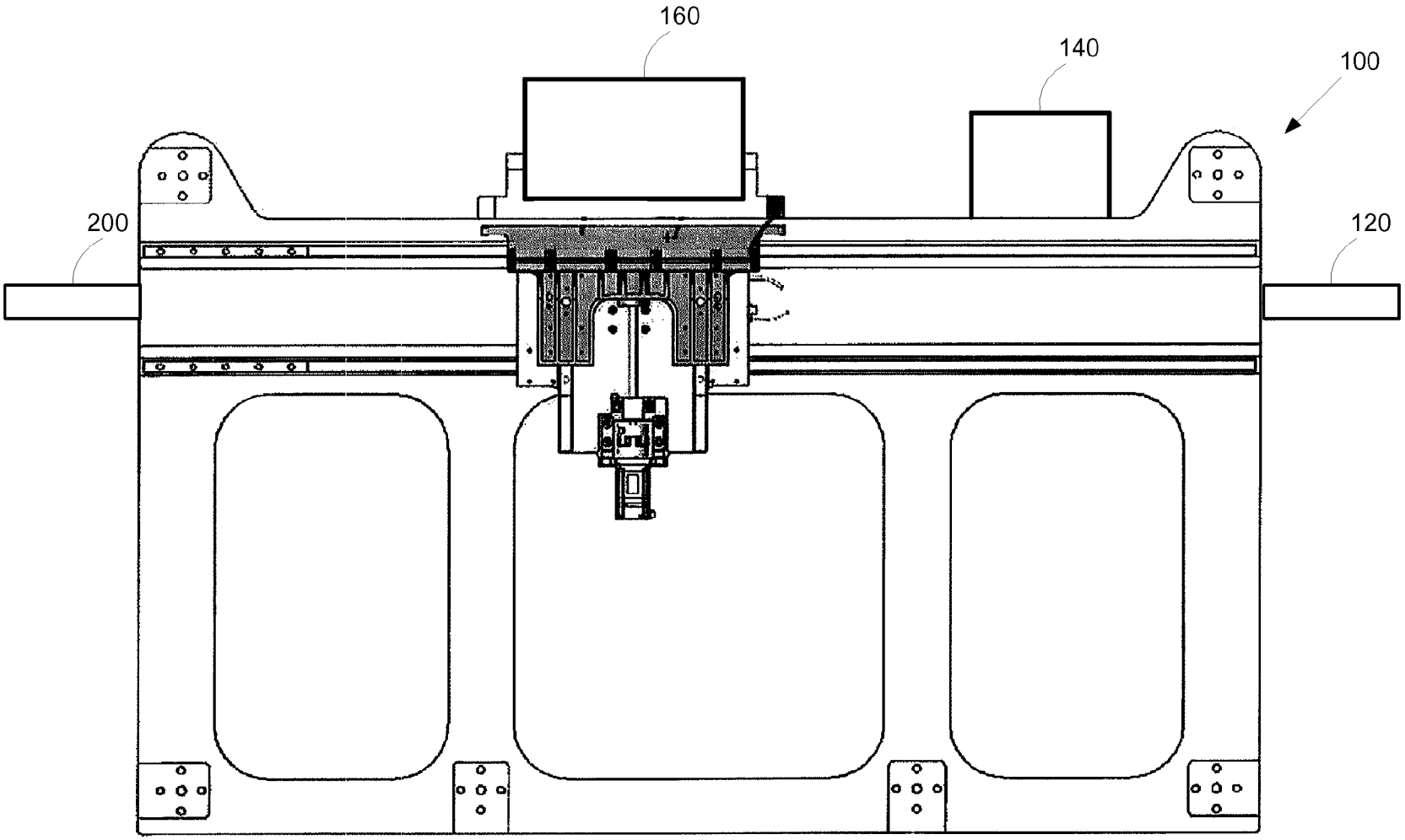
Figure 4E:
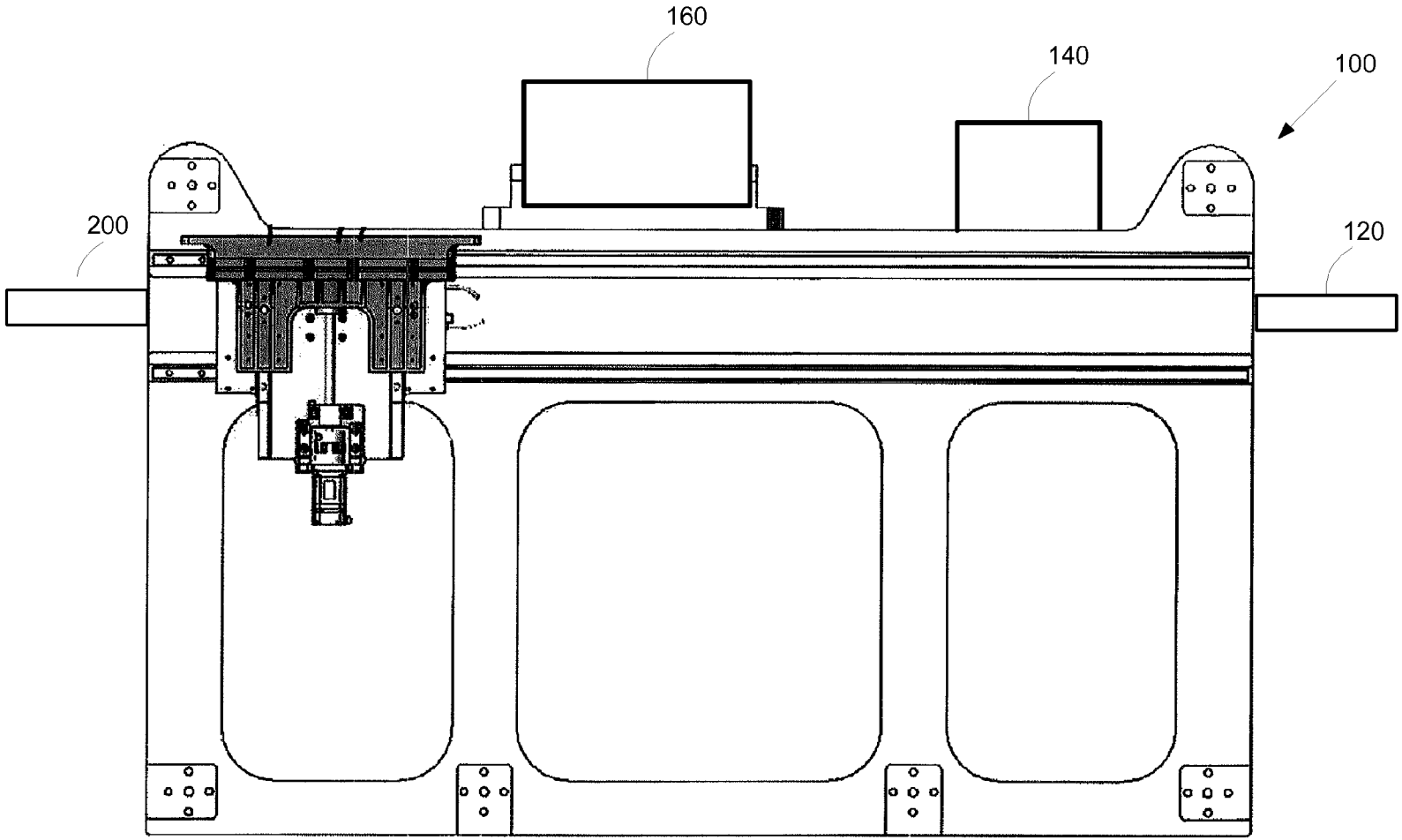
Figure 4F:
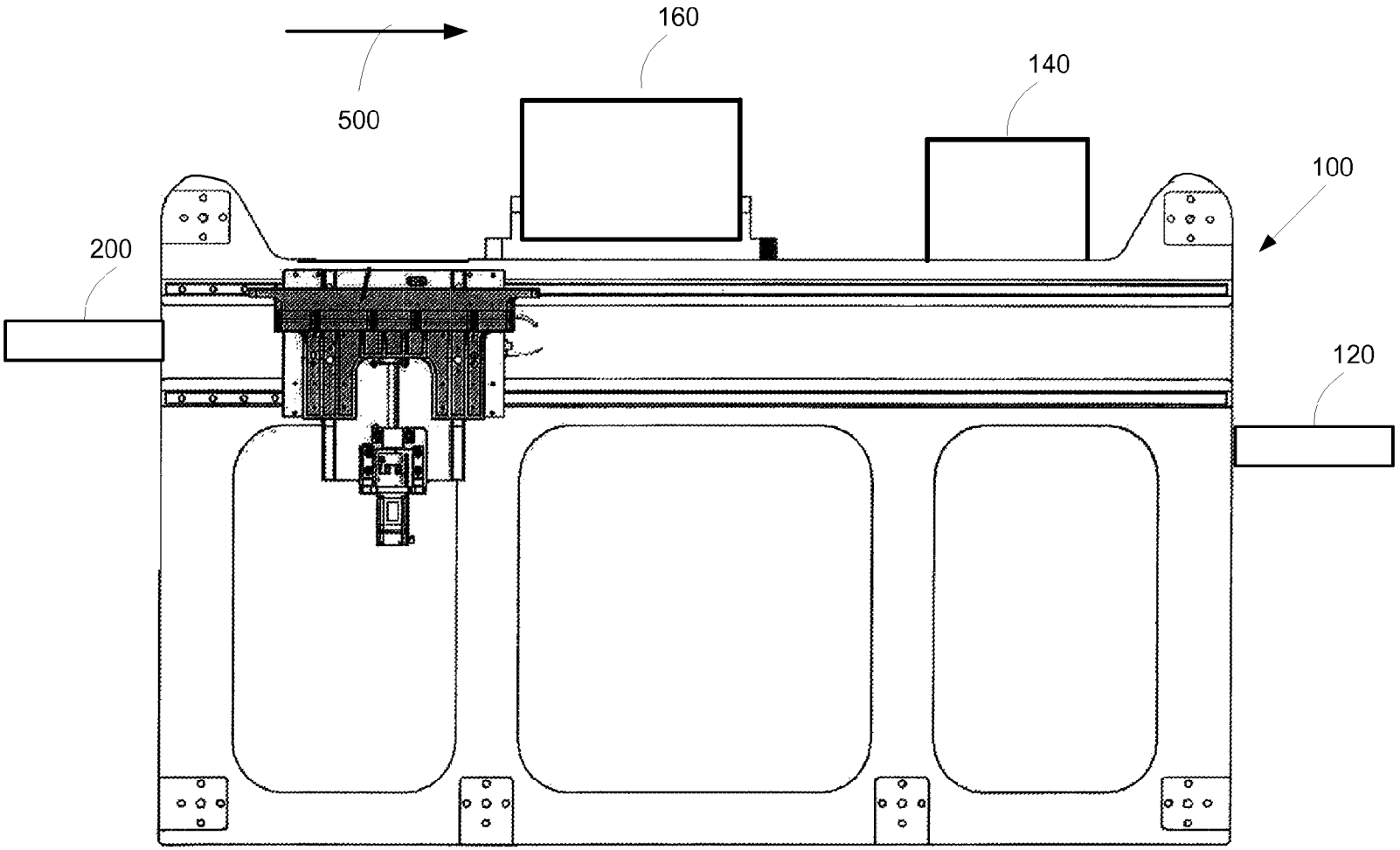
Figure 4G:
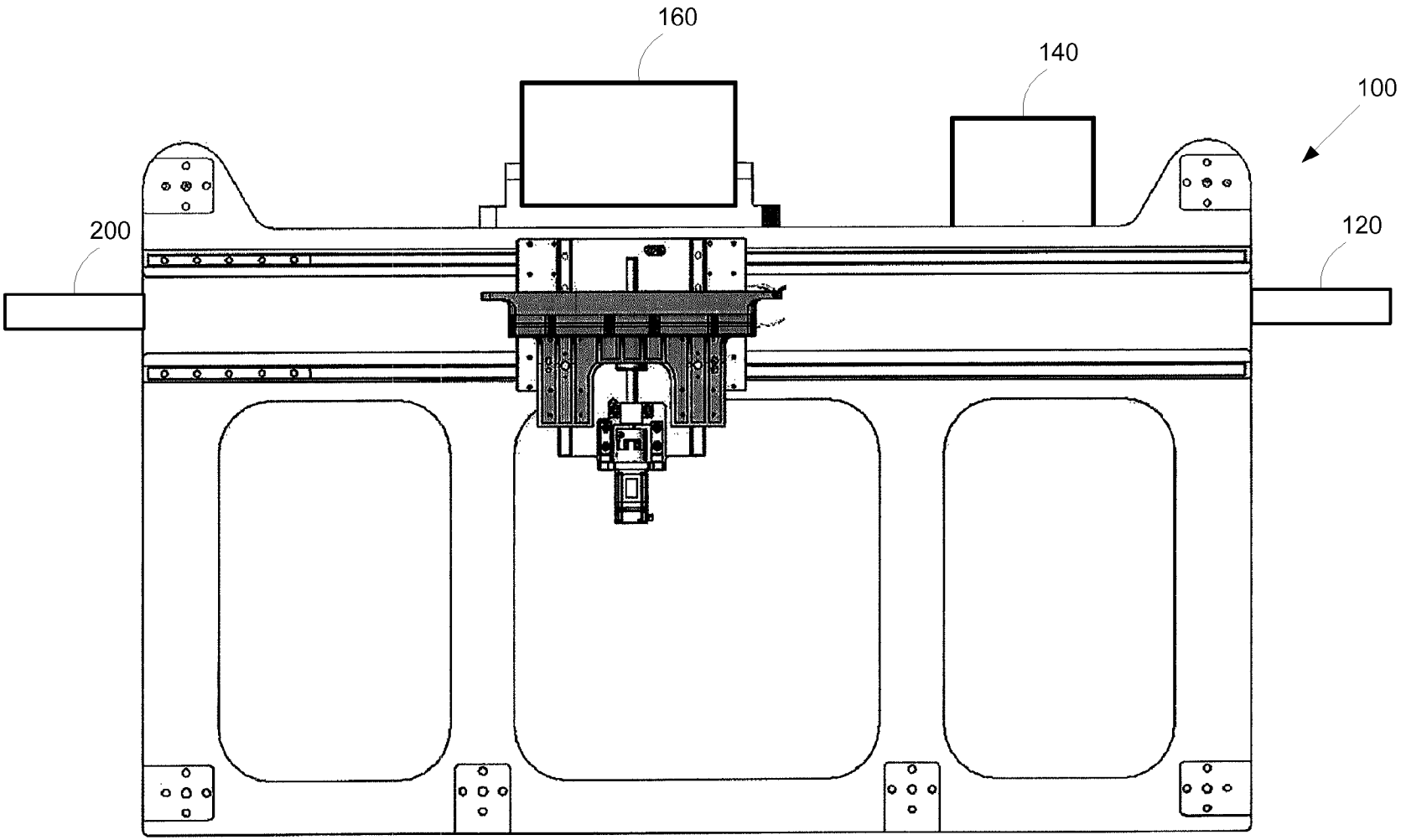
Figure 4H:
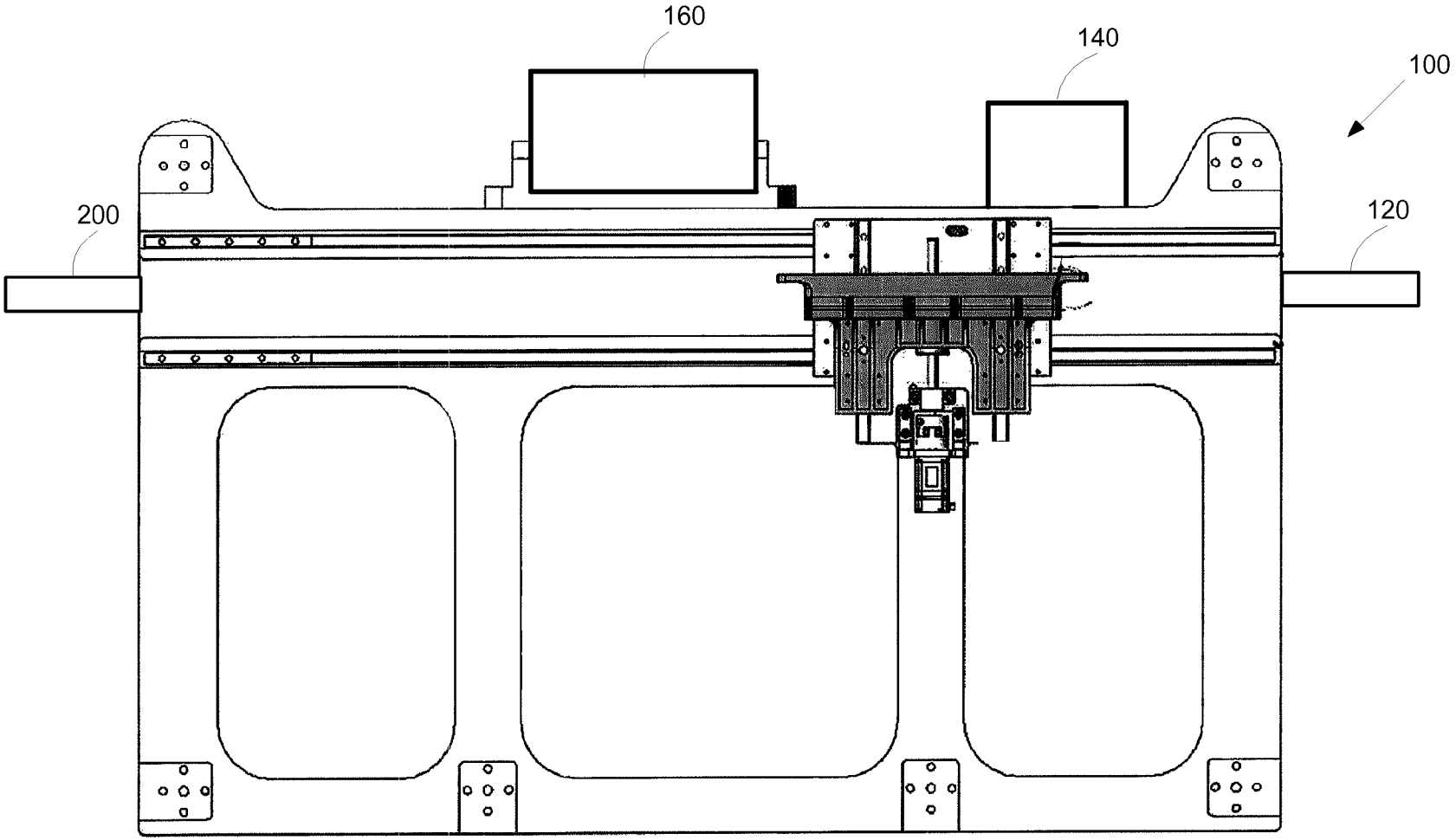

FIG. 3*a* illustrates schematically the placement of a substrate 26 on the platen 22. As mentioned previously, substrate 26 is held down onto platen 22 by some mechanical means such as clamps, grippers or vacuum. Within the alignment module 140 are located, for example, four CCD cameras as shown schematically in FIG. 3*b*. The four CCD cameras 28(*a*)-28(*d*) may be commercially available CCD cameras used in inspection systems such as those cameras available from Keyence Corporation (www.keyence.com). The CCD cameras or other suitable sensing devices such as a laser edge detector, manufactured by Omron (www.omron.com), for example, may be utilized to search for the edge or corner positions of the substrate 26 shown in FIG. 3*a* as virtual marks 30(*a*)-30(*d*), although it is understood that no actual markings are required. Edge recognition software is well known in the printing art and is available from a number of manufacturers, such as Intel Corp. and Google Corp. It is to be understood that less than four cameras may be utilized, including a single camera mounted on a mountable gantry system that moves to sense the edge of the substrate. It is also to be understood that the substrates to be printed upon may be other than a four-sided polygon, such as triangular shaped substrates, as well as substrates without any defined corners, such as of a circular shape or an oval shape. In addition, since the platen may desirably receive various dimensioned substrates, it is desirable that the CCD cameras are able to move on tracks or other suitable mechanisms to the outside corners or edges of a substrate, and to do so automatically. Once the CCD cameras have sensed the dimensions of a substrate, they are positioned to view and recognize up to four corners of the substrate, although as few as two corners can suffice. Once the corners are recognized and based upon a predetermined orientation programmed into the complete system connected to the CCD cameras, the system will note any misalignments of the substrate 26 on the platen 22. At this juncture, the platen alignment system will retain such misalignment in the memory of the computer system and transmit that misalignment information to the printing module, to be described below. It is recognized that while four CCD cameras have been described, less than four or more than four CCD cameras may be employed to detect misalignment. For example, if more than one substrate is placed on the platen, more than four CCD cameras may be required for aligning the substrates at the same time. In addition, reference points or alignment marks may be included on the substrate to be used by the CCD cameras in lieu of or in addition to the alignment by the edge corners of the substrate.

The Print Station

In operation, after indication of any misalignment has been determined by the alignment module 140, the platen 22 and substrate 26 are carried to the print station 160. It is envisioned that the printer 160 may be an ink jet printer, a laser printer, or any other type of conventional printer that has the ability to print black, color, clear or semi-clear liquid or other viscous materials onto the substrate. It is also envisioned that the printer may use a solid wax material to be printed which is then melted in the printing module and jetted or otherwise deposited on the substrate. The printer may comprise fixed printing heads, spanning the width of the machine, or scanning printing heads. As described above, any misalignment of the substrate 26 on the platen 22 is determined by the alignment module 140 and transmitted to the printer module 160. The printer module 160 may consist of R rows and C columns of ink jet heads that are placed in printer module 160 above the substrate 26, that are pre-aligned to the "ideal" position of substrate 26. Inasmuch as there are R rows by C columns of ink jet heads, any misalignment of the substrate 26 can be corrected, using suitable software to cause actuation of only certain ink jet heads such that, after the alignment module 140 transmits misalignment signal information to print module 160 and the platen 22 is positioned in the printing position, only certain of the ink jet heads may be actuated such that the misalignment of the substrate 26 is compensated for. While in one embodiment just described the ink jet heads are stationary, in another embodiment the ink jet heads may move in response to misalignment signals received from the alignment module 140.

After the ink or other material has been placed on the substrate, the printing operation is completed. The inkjet heads suitable for practicing the present invention are available, for example, from Fuji Corporation. The platen is then moved either to the Curing Module directly or first to the Unload Module and then to the Curing Module.

The Curing or Drying Module

Curing or drying module 180, hereinafter referred to as curing module or curing station, may be a conventional UV or other curing device which uses heat, radiation or any other energy source including a flash lamp or LED lamps that have the ability to cure material that has been deposited on the substrate 26. In operation, the platen 22 is transported to a position under the curing module 180 and is either stopped for the curing operation or is moved continuously under the curing lamps so that the desired degree of curing of the material is accomplished. It is envisioned that the operator may be able to adjust the degree of curing depending upon the particular purpose for which the curing is done. After the curing operation, the UV or other lamps are either shut off, or kept constantly activated to await the next work piece to be cured and the substrate 26 is then transported to an unload station 20.

Figure 14:
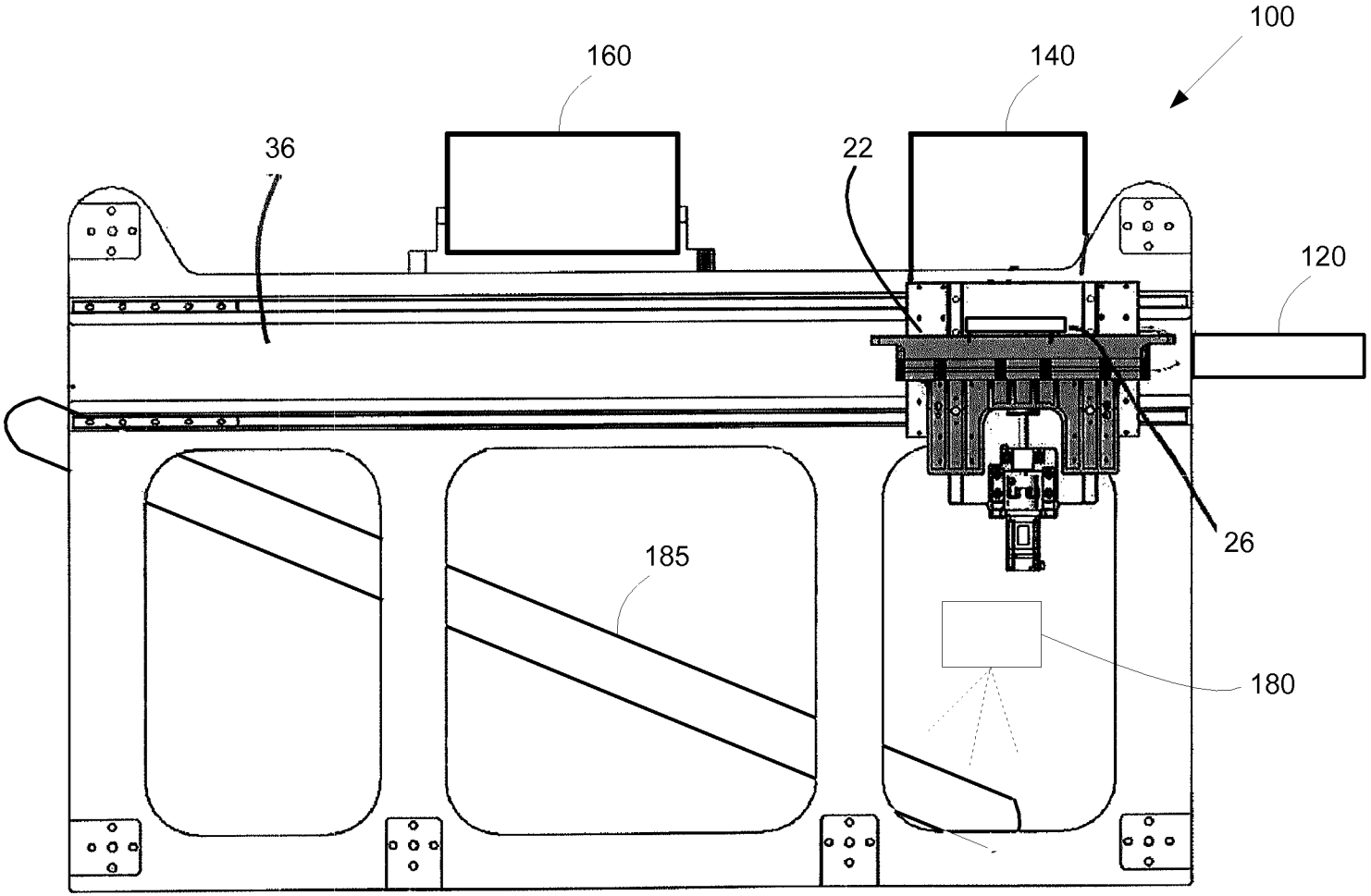
FIG. 14 shows an embodiment of the system.

According to an embodiment of the present invention, as depicted in FIG. 14, the curing station 180 is mounted at the far end of a conveyor 185 which receives the printed substrate 22 at its end close to the print station and moves it to the curing station to be cured or dried before being discharged.

As an alternative, the curing station 180 may be located external to the system 100 and may be positioned after the unload station 20 if it is desirable to do curing as a separate operation so that the flow of the printing process from the loading of substrate to the unloading of substrate is not interrupted.

The Unload Module

The unload station may be similar to the load station 120 and may comprise any number of conventional unload mechanisms using conveyor belts, grippers or any suitable means to move the substrate from under the curing module 180 along to a stack or other repository of printed substrates.

Figure 13A:
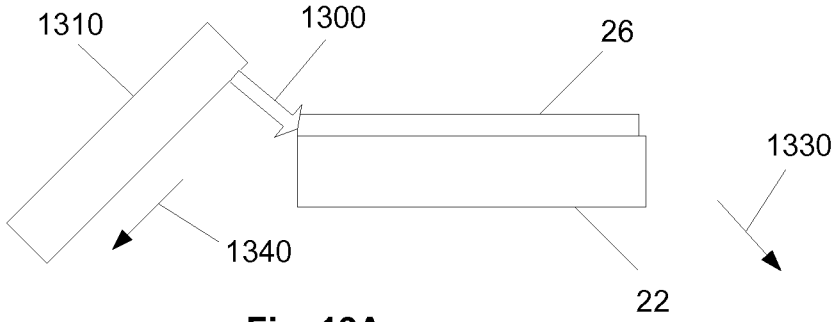
FIGS. 13*a* through 13*c* are schematic functional side-view drawings of an improved unloading mechanism.
Figure 13B:
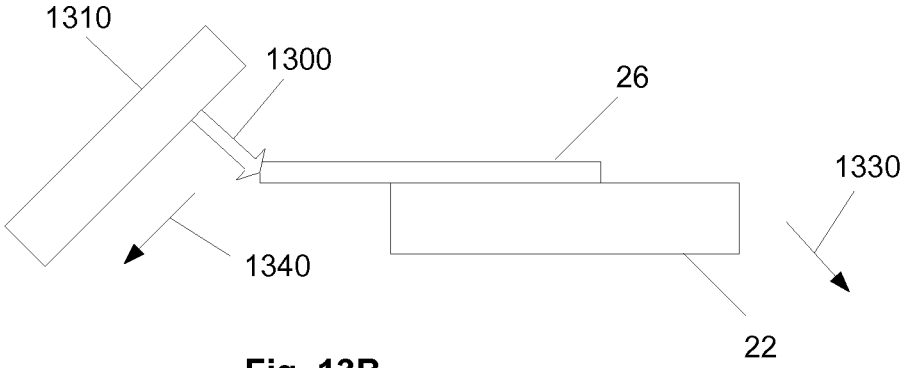
Figure 13C:
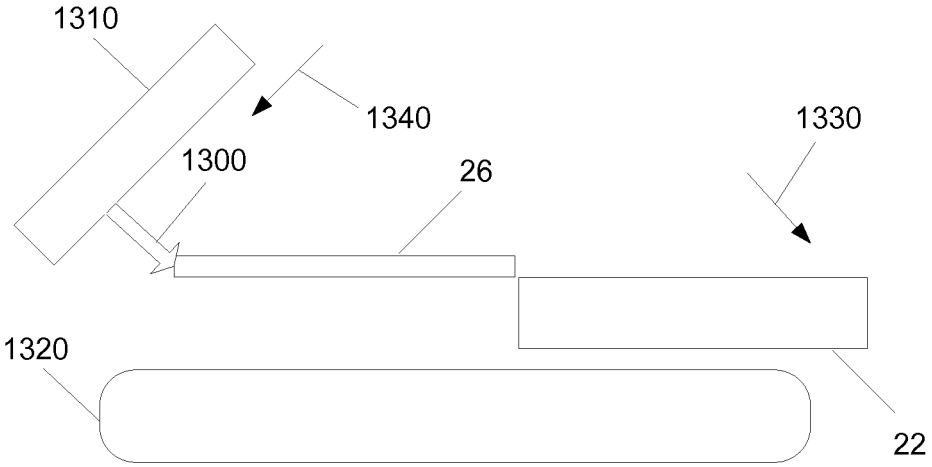

FIGS. 13A through 13C are schematic functional side-view drawings of an improved unloading mechanism 20, for unloading a printed substrate onto a conveyor. The main advantage of the improved unloading system is in that it maintains the substrate in a horizontal position throughout the unloading process, thus preventing wet ink from shifting on the substrate. The improved unloading mechanism comprises a row of grippers 1300 movably mounted on slanted plane 1310, driven by a motor or a piston (not shown).

In FIG. 13A the printed substrate 26 on platen 22 arrives at the unload station and an edge of the substrate 26 is gripped by grippers 1300.

In FIG. 13B two coordinated operations are performed in parallel. The platen moves backwards and downwards in the direction of arrow 1330, partly releasing substrate 26 and the grippers 1300 move down along the slanted plane 1310 in the direction of arrow 1340, thus maintaining substrate 26 in an essentially horizontal position and preventing wet ink from shifting on the substrate.

In FIG. 13C the platen 22 and the grippers 1300 have completed their coordinated motions and substrate 26 is dropped onto a conveyor 1320.

The Platen Transport System

Figure 7:
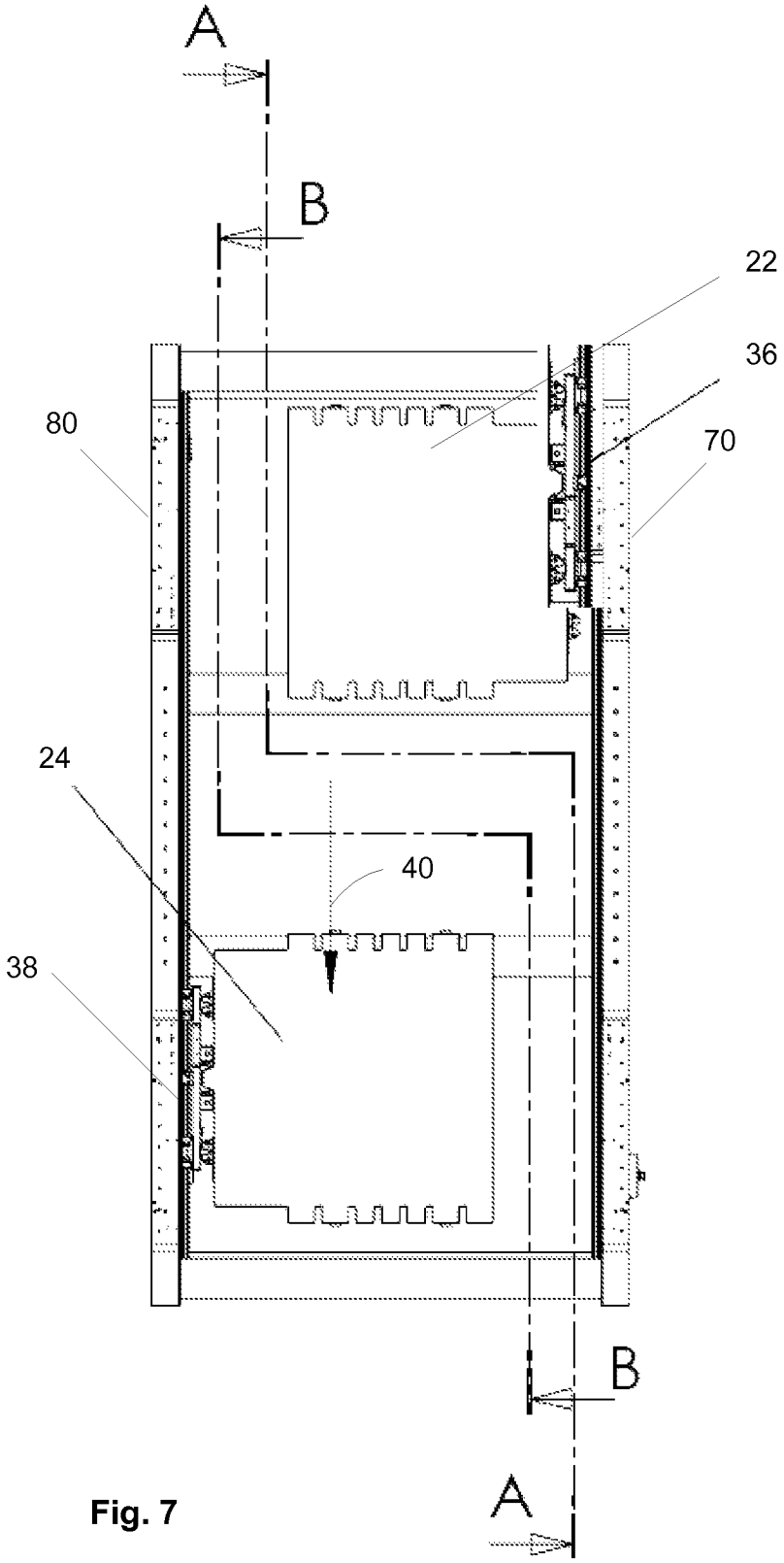
FIG. 7 is a schematic top-view of the system.

As described above it was assumed that the platen moves from the load station to the align station and to the print modules, more or less linearly in a "pizza oven" style conveyor or other mechanism. However, because, as described above, the substrate must be precisely aligned with the printing module 160 it may be desirable to affix, as described, the substrate on a work surface, for example on the platen 22. In order to increase the throughput of the printing process in the system 100, the system may be provided with two or more moveable platens. Two of such platens, 22 and 24, are shown in FIG. 7. Platens 22 and 24 are shown as each being mounted on respective rails 36 and 38 to the inner frame of the system 100, where platen 22 is mounted to the right side 70 of the frame and platen 24 is mounted to the left side 80 of the frame. As also shown in FIG. 7, by such mounting arrangement, the platens 22 and 24 may move in the direction 40. The purpose of the movement is that substrate 26 may be moved from one end of the system 100 to the other end of the system 100 corresponding to the load and unload module positions. In addition, so that the platens 22 and 24 do not collide with one another, as well as to be able to present the platens 22 or 24 carrying the substrate to the printing position, the platens may move in the directions 42 as shown in FIGS. 8*a* and 8*b*. The platens movements are controlled by the system and are independent of each other.

FIGS. 8*a* and 8*b* are respectively section views of section lines A-A and B-B of FIG. 7.

The platens may be moved along the rails 36 and 38 by any suitable known motivation devices 50 such as electric motors, stepper motors, hydraulic controls, belt drives, linear magnetic drives, or pneumatic drives. As well, the platens 22 and 24 may be moved in direction 42 by suitable known device 52 such as cam devices or hydraulic devices or the like, well known in the art, including one or more of the mechanisms described above to drive platens 22 and 24. In addition, the position of each of the platens 22 and 24 is preferably known at all times. This is because the position of each of the platens affects the timing of: the loading of the substrate onto the platen, the alignment operation in the alignment module, the alignment of the substrate when in the print module position and the position and timing of the curing module operation and the unload module operation. This may be accomplished in a number of ways using known methodologies. One technology is the use of optical encoders or magnetic encoders (resolvers) that are mounted on the system 100 and attached to each of the platens 22 and 24 that "count" the position of the platens 22 and 24 as they move through the system 100. Alternatively, edge detection, using for example photo detector devices may be located at each of the modules 120, 140, 160 and 180 to determine when a substrate is positioned under a respective module. In addition, mechanical sensors may be mounted on either of the platens 22 and 24 or each of the modules 120, 140, 160, 180 and 20.

The position and movement of the platens 22 and 24 within the system 100 are designed such that a continuous flow of substrates is accomplished through the system 100. Thus, as one substrate is being loaded onto, for example, the first platen 22, or as one substrate is being aligned or printed on, the second platen 24 may be unloading its substrate onto the unloading station. This allows more or less continuous operation rather than batch processing of the substrates 26 through the system 100. This will now be described in greater detail with reference to FIGS. 4(*a*) to 4(*h*).

Figure 9:
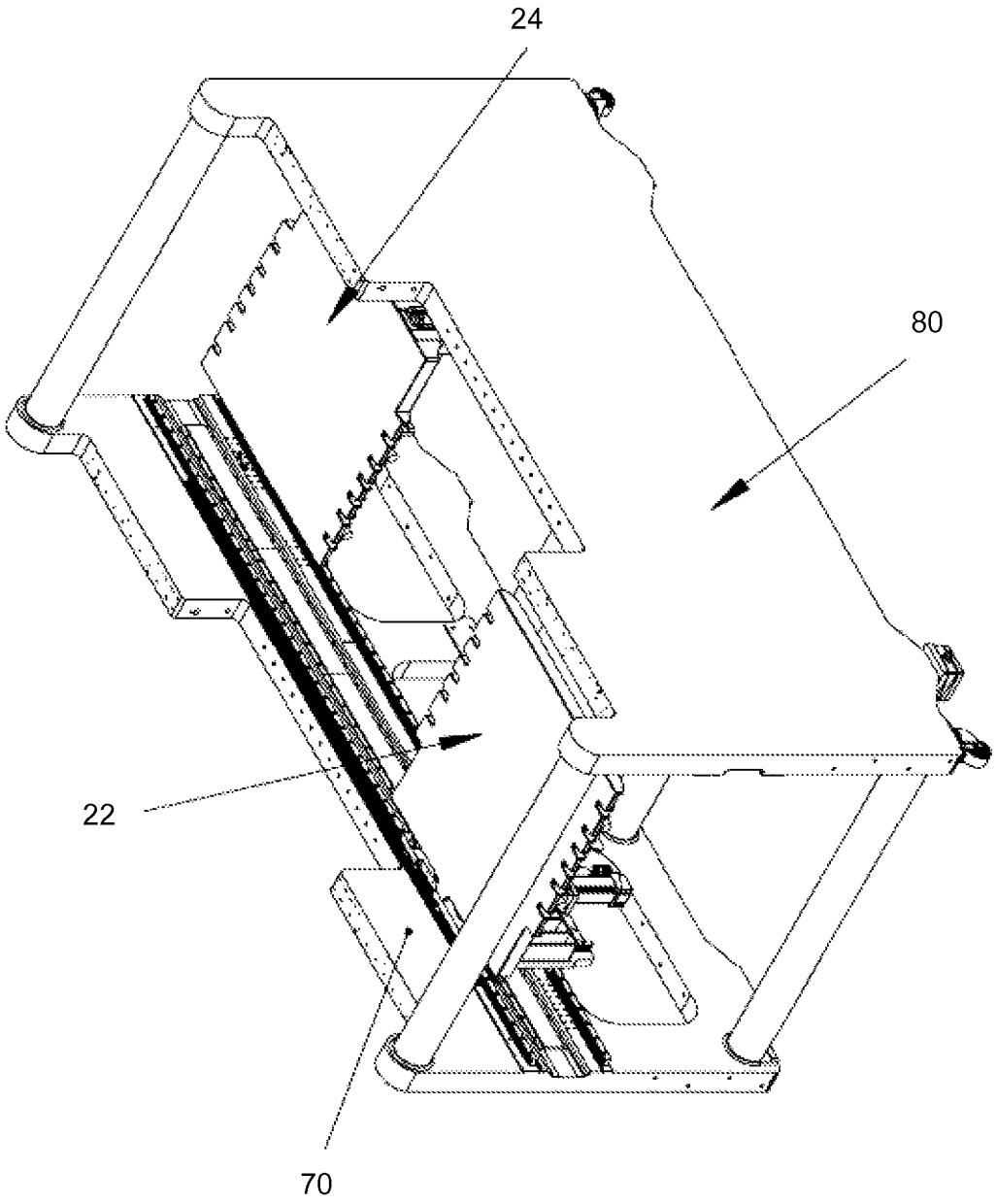
FIG. 9 is a schematic perspective view of the system.

FIG. 9 shows platens 22 and 24 at different heights, with platen 22 at a higher position than platen 24.

FIGS. 4(*a*) to 4(*h*) illustrate one embodiment of the sequence of movement of each of the platens within the system 100. For the sake of simplicity, FIGS. 4(*a*)-4(*h*) only show the movement of one of the platens 22 within the system. As is evident from FIGS. 7 through 9, there are two platens, 22 and 24, which move along their opposite respective rails 36 and 38. However, FIGS. 4(*a*)-4(*h*) show only "half" of the system. It is recognized that the other 'half" of the system is platen 24 which is mounted on the opposite side of the inner frame and moves along its rail 38. As shown in FIG. 4(*a*), the platen 22 is positioned under the alignment module 140. While platen 22 is under alignment module 140, it is understood that the platen 24 could be located at the unload station, unloading a substrate at that time in this embodiment. Thus, in sequence, starting with FIG. 4(*a*), after a substrate 26 has been loaded onto the platen 22 in the loading station 120, the alignment module 140 performs the alignment operation previously described. After the alignment operation has been completed, the platen 22 is moved towards the print station 160. Partial movement of the platen 22 is shown on FIG. 4(*b*). In FIG. 4(*c*), as the platen approaches the print module 160 it is raised in a vertical upward direction. However, it is within the preview of the invention that the platen will not be required to be raised to the print module if the alignment is performed at the same platen level as the print operation at the print module. In addition, the entire alignment module 140 may be integrated within the print module 160 in which a "look up/look down" video system known in the art may be interposed between the printer in the print module and the platen. Any misalignment is detected and alignment occurs as described above. Such "look up/look down" systems may be as described in U.S. Reissue Pat. RE 34,615 entitled "Video Probe Aligning of Object to be Acted on".

In FIG. 4(*d*) the platen is in the print position to have the substrate 22 printed upon. In FIG. 4(*e*), after the printing operation has been completed the platen 22 moves towards the unload module 20, assuming the curing module 180 is external to the system 100. Once the platen unloads the substrate 26, the platen 22 now moves back to the load module position 120. However, at the time platen 22 begins to move back to the load position, platen 24 has received a substrate at the load module 120 and is progressing towards the alignment and then the print modules. In order for the two platens not to collide, platen 22 must be moved. FIG. 4(*f*) shows that the platen 22 is moved down from its top position as it moves in direction 50. As shown in FIG. 4(*g*) when the platen 22 is below the print position it is fully in the low position. This is because approximately at the same time the platen 24 may be in the print position and the two platens need to clear each other. In FIG. 4(*h*), the platen 22 continues in its direction to the position it started out with as shown in FIG. 4(*a*) whereupon it is able to accept an additional substrate to be printed upon. Thus, it can be seen that the sequence of loading and unloading is continuous through the system 100. Thus, in an illustrative embodiment described above, the sequence is one of simultaneous loading and unloading of substrates.

Figure 5:
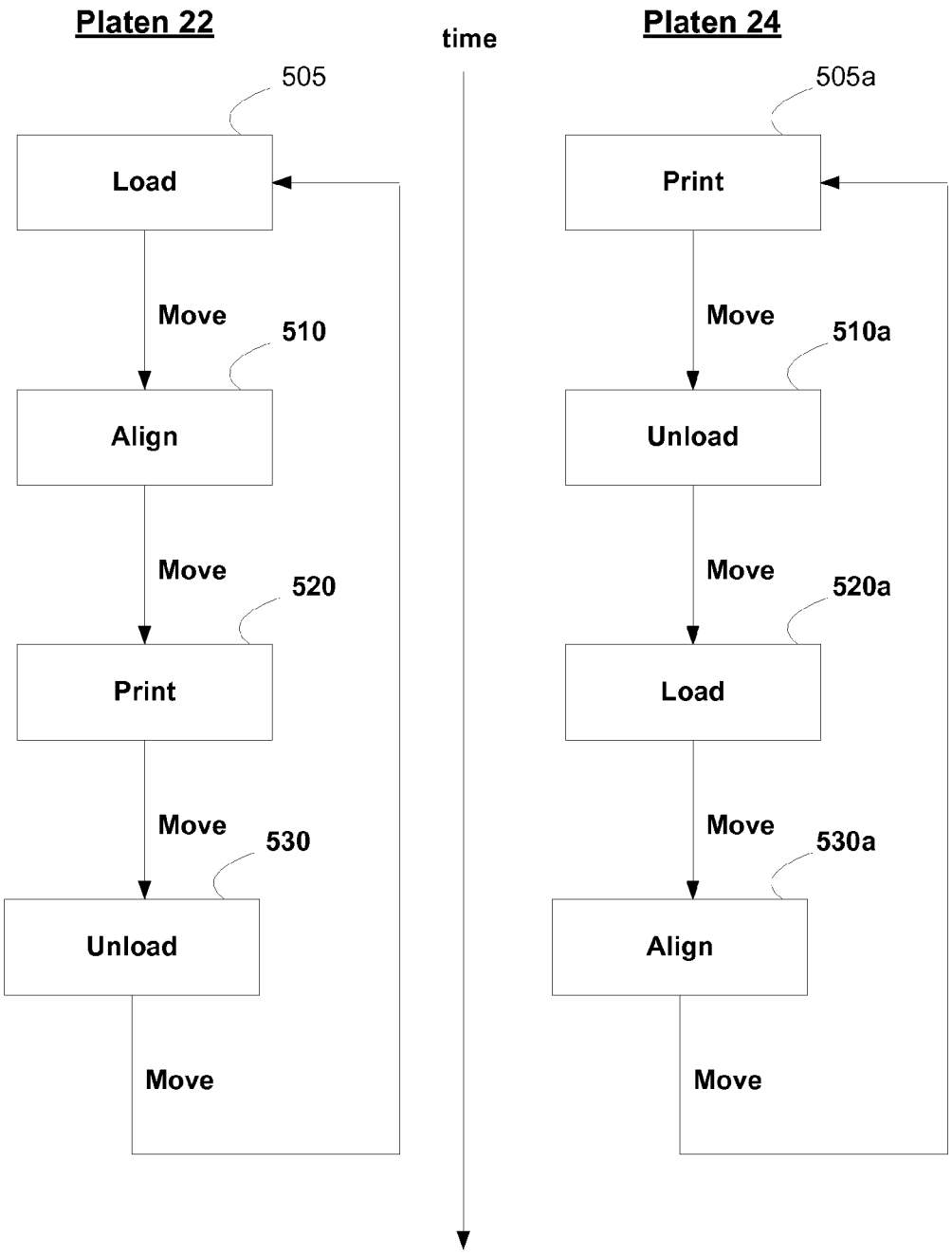
FIG. 5 is a flowchart of the process of printing materials of FIGS. 4(*a*) to 4(*i*)

FIG. 5 is a flowchart illustrating the sequence of printing operations within the system 100 utilizing two platens. Turning now to the flow chart of FIG. 5 illustrating an exemplary time-dependent workflow of the system 100, in step 505 the substrate is loaded onto the platen 22. After being loaded and secured to the platen 22 as described above, the substrate affixed on the platen 22 is moved in step 510 to alignment station in which alignment, as described above, occurs. After the substrate has been aligned, the platen 22 will then move in step 520 to the print station, whereupon the substrate on the platen 22 is printed with desired materials, as described above. After printing, the platen 22 and substrate will move in step 530 to the unload station where the substrate is unloaded from the platen 22 and either is stacked or forwarded to a curing station where in the material which has been printed upon the substrate is partially or fully cured. The platen 22 will then move back to the load station.

In parallel, while platen 22 is being loaded, platen 24 may be in the print station in step 505*a*. After printing, the platen 24 and substrate will move in step 510*a* to the unload station where the substrate is unloaded from the platen 24 and either is stacked or forwarded to a curing station where in the material which has been printed upon the substrate is partially or fully cured. In step 520*a* platen 24 moves back to the load station. After being loaded and secured to the platen 24 as described above, the substrate affixed on the platen 24 is moved in step 530*a* to alignment station in which alignment, as described above, occurs. After the substrate has been aligned, the platen 24 will then move again the print station.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination. Unless otherwise defined, all technical and scientific terms used herein have the same meanings as are commonly understood by one of ordinary skill in the art to which this invention belongs. It will be appreciated by persons skilled in the art that the present invention is not limited to what has been particularly shown and described hereinabove. Rather the scope of the present invention is defined by the appended claims and includes both combinations and sub-combinations of the various features described hereinabove as well as variations and modifications thereof which would occur to persons skilled in the art upon reading the foregoing description.

What is claimed:

1. A printing system comprising:

a load station to load one or more substrates;

said load station comprises:

a platform configured to be moved in the horizontal direction;

a row of vacuum grippers configured to grip said substrate at one end thereof;

at least one row of Bernoulli grippers;

said platform comprising a fixed part and a movable part, said movable part configured to rotate around a motor-activated axis, said row of vacuum grippers attached to said movable part and said at least one row of Bernoulli grippers attached to said fixed part; and a ramp configured to press said substrate being loaded to said at least one row of Bernoulli grippers;

a first platen to receive the one or more substrates, said first platen movably connected to a first side of said system;

a second platen to receive the one or more substrates, said second platen movably connected to a second side of said system, said second side opposite said first side;

a platen transport system operatively connected to said load station, the platen transport system moving said first and second platens in the system independently;

an alignment station which aligns the one or more substrates on said first and second platens;

a print station which prints the one or more substrate on said first and second platens; and an unload station which unloads the one or more substrates from said first and second platens, wherein said transport system comprises means to move said first and second platens in a horizontal direction and means to move said first and second platens in a vertical direction.

2. The system of claim 1, further comprising a curing/drying station which cures/dries the printed one or more substrates.

3. The system of claim 1, wherein the alignment station is configured to determine the degree of misalignment of the one or more substrates on said first and second platens according to predetermined alignment positions.

4. The system of claim 3, wherein the alignment station includes a plurality of cameras which view the location of two or more edges of the substrate to compare such locations with said predetermined alignment positions.

5. The system of claim 1, wherein the print station includes one or more ink jet print heads to print material onto the one or more substrates.

6. The system of claim 5, wherein the alignment station is configured to provide signals to the print station to cause the one or more ink jet heads to correct for any misalignment detected by the alignment station.

7. The system of claim 1, wherein said first and second platens are supported and carried by rails within the system, the rails transporting each of said first and second platens through the system in said horizontal direction.

8. The system of claim 7, wherein said first and second platens move in opposite horizontal directions within the system.

9. The system of claim 8, further including mechanisms configured to raise and lower said first and second platens to avoid said first and second platens contacting each other.

10. The system of claim 1, further comprising a mechanism on each of said first and second platens to secure the one or more substrates from movement on said platens.

11. The system of claim 10, wherein said mechanism includes one or more of: a vacuum hold-down, grippers and suction cups.

12. The system of claim 1, wherein said unload station comprises a gripper mounted on a slanted plane and movable along said slanted plane.

13. A printing method comprising:

providing a load station to load one or more substrates;

said load station comprises:

a platform configured to be moved in the horizontal direction;

a row of vacuum grippers configured to grip said substrate at one end thereof;

at least one row of Bernoulli grippers;

said platform comprising a fixed part and a movable part, said movable part configured to rotate around a motor-activated axis, said row of vacuum grippers attached to said movable part and said at least one row of Bernoulli grippers attached to said fixed part; and a ramp configured to press said substrate being loaded to said at least one row of Bernoulli grippers;

providing a first platen to received one or more substrates from said load station;

providing a second platen to received one or more substrates from said load station;

providing a platen transport system operatively connected to said load station, said platen transport system adapted to move said first and second platens in the system independently in a horizontal direction and in a vertical direction;

loading one or more substrates to said first platen;

moving said first platen horizontally to an alignment station which aligns the one or more substrates on said first platen;

moving said first platen horizontally to a print station, the print station printing onto the one or more substrates on said first platen;

moving said first platen horizontally to an unload station which unloads the one or more substrates from said first platen;

loading one or more substrates to said second platen;

moving said second platen horizontally to an alignment station which aligns the one or more substrates on said second platen;

moving said second platen horizontally to a print station, the print station printing onto the one or more substrates on said second platen; and moving said second platen horizontally to an unload station which unloads the one or more substrates from said second platen, wherein said moving said first platen to said alignment station and said moving said second platen to said alignment station occur at different times, wherein said moving said first platen to said print station and said moving said second platen to said print station occur at different times, wherein said moving said first platen to said unload station and said moving said second platen to said unload station occur at different times, and wherein said first and second platens are moved vertically between said horizontal movements to avoid interference.

14. The method of claim 13, further comprising moving said first platen to a curing/drying station which cures/dries the one or more substrates which have been printed and moving said second platen to a curing station which cures the one or more substrates which have been printed, wherein said moving said first platen to said curing station and said moving said second platen to said curing station occur at different times.

15. The method of claim 13, wherein said loading comprises:

a. gripping a first end of each said one or more substrates with a first row of vacuum grippers;

b. elevating said one or more gripped ends;

c. moving said one or more substrates in the horizontal direction of said first row of grippers;

d. pressing said one or more substrate against a ramp and gripping it with a second row of Bernoulli grippers;

e. repeating steps (c) and (d) if additional rows of grippers exist; and f. releasing said one or more substrates from said grippers onto a platen.

16. The method of claim 13, wherein said unloading comprises:

a. gripping a first end of said one or more substrates on said first platen with a row of grippers mounted on a slanted plane and movable along said slanted plane;

b. simultaneously moving said first platen in a horizontal direction away from said grippers and moving said grippers down on said slanted plane, whereby said one or more substrates remains horizontal;

c. repeating step (b) until said one or more substrates are removed from said first platen; and d. releasing said one or more substrates from said grippers.

17. A substrate loading system comprising:

a row of vacuum grippers configured to grip said substrate at one end thereof;

at least one row of Bernoulli grippers;

said vacuum grippers and said Bernoulli grippers mounted on a common platform moveable in a horizontal direction;

said platform comprising a fixed part and a rotatable part, said rotatable part configured to rotate around a motor-activated axis, said row of vacuum grippers attached to said movable part and said at least one row of Bernoulli grippers attached to said fixed part; and a ramp configured to press said substrate being loaded to said at least one row of Bernoulli grippers.

18. A method of loading a substrate onto a platen comprising:

a. gripping a first end of said substrate with a first row of vacuum grippers;

b. elevating said gripped end;

c. moving said substrate in the horizontal direction of said first row of grippers;

d. pressing said substrate against a ramp and gripping it with a second row of Bernoulli grippers;

e. repeating steps (c) and (d) if additional rows of grippers exist; and f. releasing said substrate from said grippers onto a platen.

19. A substrate unloading system comprising:

a row of grippers mounted on a slanted plane and movable along said slanted plane, said grippers configured to grip a substrate at one end thereof; and a platen onto which said substrate is attached, said platen configured to be moved down in a vertical direction and away from said gripper in a horizontal direction while unloading said substrate, said row of gripper and said platen configured to move simultaneously so that said substrate remains substantially horizontal.

20. A method of unloading a substrate from a platen comprising:

a. gripping one end of said substrate on said platen with a row of grippers mounted on a slanted plane and movable along said slanted plane;

b. simultaneously moving said platen in both vertical and horizontal direction away from said grippers and moving said grippers down along said slanted plane until said substrate is removed from said platen, whereby said substrate remains horizontal; and c. releasing said substrate from said grippers.

* * * * *